US011352838B2

(12) United States Patent
Grensing et al.

(10) Patent No.: US 11,352,838 B2
(45) **Date of Patent: *Jun. 7, 2022**

(54) LOW FRICTION AND HIGH WEAR RESISTANT SUCKER ROD STRING

(71) Applicant: MATERION CORPORATION, Mayfield Heights, OH (US)

(72) Inventors: Fritz C. Grensing, Perrysburg, OH (US); Diane M. Nielsen, Kingwood, TX (US); William D. Nielsen, Kingwood, TX (US); Richard E. Cash, Richmond, TX (US); Christopher W. Damschroder, Elmore, OH (US)

(73) Assignee: Materion Corporation, Mayfield Heights, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/065,093

(22) Filed: Oct. 7, 2020

(65) Prior Publication Data

US 2021/0017817 A1 Jan. 21, 2021

Related U.S. Application Data

(63) Continuation of application No. 16/256,756, filed on Jan. 24, 2019, now Pat. No. 10,844,671, which is a (Continued)

(51) Int. Cl.

| | |
|---|---|
| ***E21B 17/042*** | (2006.01) |
| ***E21B 43/12*** | (2006.01) |
| ***C22C 9/06*** | (2006.01) |

(52) U.S. Cl.

CPC ..... *E21B 17/042* (2013.01); *C22C 9/06* (2013.01); *E21B 43/127* (2013.01)

(58) Field of Classification Search

CPC .... E21B 17/04; E21B 17/042; E21B 17/0423; E21B 17/1071; F16D 1/02; F16D 2200/0026; F16D 2200/003; C22C 9/06

See application file for complete search history.

(56) References Cited

U.S. PATENT DOCUMENTS

| | | | |
|---|---|---|---|
| 620,265 | A | 2/1899 | Windle |
| 1,452,937 | A | 4/1923 | Shaffer |

(Continued)

FOREIGN PATENT DOCUMENTS

| | | | |
|---|---|---|---|
| CA | 2425091 | A1 | 10/2004 |
| CA | 2469583 | A1 | 12/2004 |

(Continued)

OTHER PUBLICATIONS

Cribb, et al., Copper Spinodal Alloys, Nov. 2002, Advanced Materialls & Processes (Year: 2002).*

(Continued)

*Primary Examiner* — Cathleen R Hutchins
(74) *Attorney, Agent, or Firm* — Cozen O'Connor

(57) ABSTRACT

A sucker rod string is formed from sucker rods and sucker rod couplings. The sucker rod couplings are formed from a spinodally-hardened copper alloy comprising from about 8 to about 20 wt % nickel, and from about 5 to about 11 wt % tin, the remaining balance being copper, and having a sliding coefficient of friction of 0.4 or less when measured against carbon steel. The sucker rod string has low friction and improved pumping stroke, enhanced pumping capacity, and less load in the overall system.

20 Claims, 30 Drawing Sheets

Related U.S. Application Data continuation-in-part of application No. 14/633,593, filed on Feb. 27, 2015, now Pat. No. 10,435,955, and a continuation-in-part of application No. 14/581,521, filed on Dec. 23, 2014, now Pat. No. 10,597,949.

(60) Provisional application No. 62/621,348, filed on Jan. 24, 2018, provisional application No. 62/065,275, filed on Oct. 17, 2014, provisional application No. 62/008,324, filed on Jun. 5, 2014, provisional application No. 61/969,424, filed on Mar. 24, 2014.

(56) References Cited

U.S. PATENT DOCUMENTS

| | | | |
|---|---|---|---|
| 1,607,941 | A | 11/1926 | Bowser |
| 1,629,058 | A | 5/1927 | Wilson |
| 2,049,265 | A | 7/1936 | Kinney |
| 2,563,038 | A | 8/1951 | Stanley |
| 2,601,478 | A | 6/1952 | Weir |
| 2,690,934 | A | 10/1954 | Holcombe |
| 3,201,158 | A | 8/1965 | Meripol |
| 4,139,334 | A | 2/1979 | Payne et al. |
| 4,406,561 | A | 9/1983 | Ewing |
| 4,431,219 | A | 2/1984 | Brewer et al. |
| 4,484,833 | A | 11/1984 | Gallagher |
| 4,602,807 | A | 7/1986 | Bowers |
| 4,641,976 | A | 2/1987 | Kar |
| 4,668,117 | A | 5/1987 | Bair |
| 4,772,246 | A | 9/1988 | Wenzel |
| 4,822,201 | A | 4/1989 | Iwasaki et al. |
| 4,823,456 | A | 4/1989 | Gray |
| 4,905,760 | A | 3/1990 | Gray |
| 5,119,876 | A | 6/1992 | Sable |
| RE34,467 | E | 12/1993 | Reeves |
| 5,334,268 | A | 8/1994 | Hermanson et al. |
| 5,405,461 | A | 4/1995 | Hermanson et al. |
| 6,371,224 | B1 | 4/2002 | Freeman et al. |
| 6,413,326 | B1 | 7/2002 | Rallis |
| 6,716,292 | B2 | 4/2004 | Nielsen, Jr. et al. |
| 6,837,643 | B2 | 1/2005 | Lauder |
| 7,168,924 | B2 | 1/2007 | Beck et al. |
| 7,360,609 | B1 | 4/2008 | Falgout, Sr. |
| 7,647,963 | B2 | 1/2010 | Carstensen |
| 10,435,955 | B2 | 10/2019 | Nielsen et al. |
| 2001/0000550 | A1 | 5/2001 | Newman |
| 2002/0007879 | A1 | 1/2002 | Nielsen, Jr. et al. |
| 2002/0076273 | A1 | 6/2002 | Carstensen |
| 2002/0122722 | A1 | 9/2002 | Bertin et al. |
| 2004/0174017 | A1 | 9/2004 | Brill et al. |
| 2004/0228679 | A1 | 11/2004 | Reavis et al. |
| 2005/0118364 | A1 | 6/2005 | Guise et al. |
| 2006/0225891 | A1 | 10/2006 | Adams et al. |
| 2006/0273601 | A1* | 12/2006 | Carstensen ..... E21B 17/0426 294/91 |
| 2008/0035329 | A1 | 2/2008 | Carstensen |
| 2009/0275415 | A1 | 11/2009 | Prill et al. |
| 2011/0203790 | A1 | 8/2011 | Carstensen |
| 2012/0074692 | A1 | 3/2012 | Chelette et al. |
| 2012/0211237 | A1 | 8/2012 | Rich |
| 2014/0311633 | A1 | 10/2014 | Cribb et al. |
| 2015/0267477 | A1 | 9/2015 | Nielsen et al. |
| 2015/0354287 | A1 | 12/2015 | Nielsen et al. |
| 2015/0376996 | A1 | 12/2015 | Downing |
| 2016/0060968 | A1 | 3/2016 | Xie |
| 2016/0237796 | A1 | 8/2016 | Stachowiak et al. |
| 2016/0376851 | A1 | 12/2016 | Morrow |
| 2018/0112503 | A1 | 4/2018 | Lane et al. |
| 2018/0163485 | A1 | 6/2018 | Song et al. |
| 2018/0266190 | A1 | 9/2018 | Nielsen, Jr. et al. |
| 2019/0128075 | A1 | 5/2019 | Urech |
| 2019/0242197 | A1 | 8/2019 | Grensing et al. |
| 2019/0360279 | A1 | 11/2019 | Trowbridge et al. |

FOREIGN PATENT DOCUMENTS

| | | | |
|---|---|---|---|
| GB | 572089 | A | 9/1945 |
| GB | 2126675 | A | 3/1984 |
| JP | S57-187888 | U | 11/1982 |
| JP | S6314987 | A | 1/1988 |
| JP | H11-506804 | A | 6/1999 |
| RU | 2077654 | C1 | 4/1997 |
| RU | 2150040 | C1 | 5/2000 |
| RU | 2348720 | C2 | 3/2009 |
| RU | 2508415 | C2 | 2/2014 |
| WO | 96/41033 | A1 | 12/1996 |
| WO | 2011/005403 | A1 | 1/2011 |
| WO | 2012039700 | A1 | 3/2012 |
| WO | 2013053449 | A2 | 4/2013 |
| WO | 2014176357 | A1 | 10/2014 |
| WO | 2015187217 | A1 | 12/2015 |

OTHER PUBLICATIONS

S. Ilangovan et al, "Effects of Tin on Hardness, Wear Rate and Coefficient of Friction of Case CU—NI—SN Alloys," Journal of Engineering Science and Technology, Feb. 1, 2013, paqes 34-43, vol. 8, No. 1, Amrita School of Enqineerino, Tamilnadu, India.

W. Raymond Cribb et al, "Performance Advances in Copper-Nickel-Tin Spinodal Alloys," Advanced Materials & Processes, Sep. 1, 2013, pp. 20-25.

International Search Report for PCT Application PCT/US2018/023385 dated Jun. 8, 2018.

Cribb et al., "Spinodal copper alloy C72900—new high strength antifriction alloy system", Canadian Metallurgical Quarterly, vol. 50, No. 3, 2011, pp. 232-239.

Cribb et al., "Copper Spinodal Alloys: New technology enables production of larger copper parts with the high-strength spinodal structure", Advanced Materials & Processes, Nov. 2002, pp. 1-4.

International Search Report and Written Opinion in PCT/US2015/017985 dated Jun. 8, 2015.

Norris Couplings Accessories sucker rod specification sheet, date unknown.

Specification for Sucker Rods, Polished Rods and Liners, Couplings, Sinker Bars, Polished Rod Clamps, Stuffing Boxes, and Pumping Tees; American Petroleum Institute, API Specification 11B, 27th Edition, May 2010, Effective Date: Nov. 1, 2010.

Search Report from Russian Application No. 2016150898 dated Oct. 15, 2018.

Extended European Search Report for European Application No. 15830567.5 dated Jan. 5, 2018.

Chinese Office Action for Chinese Application No. 2015800297769 dated Nov. 3, 2017.

* cited by examiner

Oscillating axial motion with side loading. Average bearing stress @ 2,000 psi. Carburized steel shaft No. 4 well shows run time improvment with ToughMet couplings in the lower 600 ft of the 1 inch bottom rods

LOW FRICTION AND HIGH WEAR RESISTANT SUCKER ROD STRING

CROSS-REFERENCE TO RELATED APPLICATIONS

This application is a continuation of U.S. Ser. No. 16/256,756, filed Jan. 24, 2019, which claims priority to U.S. Provisional Patent Application Ser. No. 62/621,348, filed Jan. 24, 2018. This application is also a continuation-in-part of U.S. Patent Application Ser. No. 14/633,593, filed Feb. 27, 2015, which claimed priority to U.S. Provisional Patent Application Ser. No. 62/065,275, filed Oct. 17, 2014, and U.S. Provisional Patent Application Ser. No. 62/008,324, filed Jun. 5, 2014. This application is also a continuation-in-part of U.S. Patent Application Ser. No. 14/581,521, filed Dec. 23, 2014, which claimed priority to U.S. Provisional Patent Application Ser. No. 61/969,424, filed Mar. 24, 2014. These applications are fully incorporated by reference in their entirety.

BACKGROUND

The present disclosure relates to low friction and high wear resistant sucker rod couplings and sucker rod strings made therefrom for use with various well fluid extraction systems. One or more of the sucker rod couplings are made from spinodally-hardened copper-nickel-tin alloys having certain characteristics. The couplings are particularly useful in certain locations/positions for connecting sucker rods to form a sucker rod string having specific desired properties. Such sucker rod couplings and their associated sucker rod strings enhance fluid extraction and reduce overall well operation costs.

Fluid extraction apparatuses typically include a pump in the bottom of a well for extracting fluid from an underground reservoir; a conduit, also known as production tubing, through which the produced fluids travel; a power source for providing power to the pump, and a sucker rod lift system located within the conduit. Typical fluids for extraction from underground reservoirs include water, and various hydrocarbons including oil and gas.

The sucker rod lift system includes a series of sucker rods that are joined together by couplings to form a sucker rod string. The sucker rod string is situated inside a conduit or production tubing. The rods and couplings are frequently joined by a pin-and-box threaded connection. Damage to threaded connections due to galling (wear due to adhesion between sliding surfaces) can compromise the mechanical integrity of the joint and lead to failure of the connection between the power source and the pump.

In addition, damage within the conduit caused by repetitive contact between the outer surface of the sucker rod string and the inner surface of the conduit (which is generally made of steel) can compromise the mechanical integrity of the conduit, leading to leakage of the fluid carried by the conduit into the environment. Such leakage effectively stops the pumping process and often leads to very costly additional operations to remediate such failures. This damage is usually more likely to occur in situations where the well walls and/or conduit are deviated (curved), such as in wells produced by directional or deviated drilling.

Desired characteristics of sucker rod couplings include high strength, wear resistance, galling resistance, and corrosion resistance. Conventional couplings are typically comprised of steel or nickel alloys which lack the full complement of preferred intrinsic characteristics, particularly galling resistance. Surface treatments are typically used to increase galling resistance on couplings made from steel or nickel alloys, as well as on the inside of the conduit inside which the coupling is disposed. These surface treatments eventually wear off, and must be re-applied periodically over the course of the lifetime of the parts in order to be effective.

It would be desirable to develop new sucker rod couplings and associated sucker rod strings having improved intrinsic desirable properties.

BRIEF DESCRIPTION

The present disclosure relates to sucker rod couplings made from certain low friction and high wear resistant spinodally-hardened copper-nickel-tin alloys, and associated sucker rod strings comprising the same. The couplings have a unique combination of properties including high tensile strength, high fatigue strength, high fracture toughness, wear resistance, galling resistance, and corrosion resistance. This combination of properties delays the occurrence of destructive damage to the couplings and other components in pump systems using such couplings (e.g., sucker rods and conduits), while providing mechanical functionality during hydrocarbon recovery operations. This also extends the useful service life of such components, significantly reducing the costs of equipment used to recover hydrocarbons.

Additionally, the sucker rod couplings of the present disclosure also exhibit low friction properties, thereby reducing damage (i.e. rod and tube failures) and enhancing pumping capacity and output. In particular, the use of these sucker rod couplings and associated sucker rod strings result in the use of less pumping power, as well as providing enhanced pumping capacity.

Furthermore, use of the sucker rod strings described herein (which use the copper-nickel-tin couplings in certain positions as specified below) reduces HIT failures, reduces lifting costs, and increases well production. Reducing failures in the well is particularly important when working over deviated shale wells operating on artificial lifts, as the costs of working over these deviated wells are significant. A large number of the failures in these wells are related to either tubing or sucker rod string failures, caused primarily by wear damage resulting from components of the sucker rod string contacting the inner walls of the production tubing. When installed in operational wells, the sucker rod strings described herein improve pumping stroke and liquid production, while lessening load in the overall system.

Disclosed in various embodiments herein are sucker rod strings comprising a set of couplings. The set of couplings includes a plurality of couplings made from a copper-nickel-tin alloy. The copper-nickel-tin alloy comprises from about 8 to about 20 wt % nickel, and from about 5 to about 11 wt % tin, and has a sliding coefficient of friction of less than 0.4 when measured against carbon steel.

The plurality of couplings made from the copper-nickel-tin alloy may be located in a lower pump end of the sucker rod string, or an upper motor end of the sucker rod string, or a center section of the sucker rod string, or a bottom section of the sucker rod string. This placement permits the advantageous properties of the copper-nickel-tin alloy couplings to be concentrated in the sucker rod string where they are needed. Put another way, at least 25%, or at least 50%, or 100% of the couplings in the lower pump end, or the upper motor end, or the center section, or the bottom section of the sucker rod string are made from the copper-nickel-tin alloy.

In certain more specific embodiments, the plurality of couplings made from the copper-nickel-tin alloy includes at least 5 couplings, or at least 10 couplings, or from 10 to 15 couplings, or from 25 to 40 couplings, or at least 55 couplings. In particular embodiments, all of the couplings in the set of couplings are made from the copper-nickel-tin alloy. Put another way, at least 5%, at least 10%, or at least 20%, or at least 25%, or at least 50%, or 100% of the couplings in the sucker rod string are made from the copper-nickel-tin alloy.

In some embodiments, the set of couplings includes (a) the plurality of couplings made from the copper-nickel-tin alloy; and (b) a plurality of non-copper couplings. The couplings made from the copper-nickel-tin can be alternated with the non-copper couplings.

The copper-nickel-tin alloy may also have a sliding coefficient of friction of 0.3 or less, or 0.2 or less, when measured against carbon steel.

Further disclosed are methods of extracting a fluid from a well, comprising: connecting a downhole pump to a motor using a sucker rod string; and operating the downhole pump using the sucker rod string to extract fluid from the well. The sucker rod string comprises a set of couplings, wherein the set of couplings includes a plurality of couplings made from a copper-nickel-tin alloy; and wherein the copper-nickel-tin alloy comprises from about 8 to about 20 wt % nickel, and from about 5 to about 11 wt % tin, and has a sliding coefficient of friction of less than 0.4 when measured against carbon steel.

In particular embodiments, the well is a deviated well or a well produced by non-linear directional drilling.

Using the sucker rod strings of the present disclosure, a pump stroke of the pump may be increased by about 3% to about 40% compared to when the sucker rod string uses SM steel couplings. The fluid production of the well may be increased by about 3% to about 40% compared to when the sucker rod string uses SM steel couplings. The average peak load on the pump and associated equipment may be reduced by at least 5% compared to when the sucker rod string uses SM steel couplings. The run time may be increased by at least 5%, or at least 10%, or at least 100%, or at least 200%, or at least 300% compared to when the sucker rod string uses SM steel couplings. The continuous run time of the pump may be at least one year.

Also disclosed are methods for reducing lifting costs, increasing production, and/or reducing tube failures in a deviated well, comprising using a sucker rod string that comprises a set of couplings, wherein the set of couplings includes a plurality of couplings made from a copper-nickel-tin alloy; and wherein the copper-nickel-tin alloy comprises from about 8 to about 20 wt % nickel, and from about 5 to about 11 wt % tin, and has a sliding coefficient of friction of less than 0.4 when measured against carbon steel.

Further disclosed herein in various embodiments are couplings for a sucker rod, comprising a spinodally-hardened copper-nickel-tin alloy comprising from about 8 to about 20 wt % nickel, and from about 5 to about 11 wt % tin, the remaining balance being copper, wherein the alloy has a 0.2% offset yield strength of at least 75 ksi and a low sliding coefficient of friction of less than 0.4 (when measured by sliding against carbon steel), including 0.2 or less, and including about 0.175. The coupling is formed from a core having a first end and a second end, each end containing an internal thread. An exterior surface of the core may include at least one groove running from the first end to the second end.

The copper-nickel-tin alloy can comprise, in more specific embodiments, about 14.5 wt % to about 15.5 wt % nickel, and about 7.5 wt % to about 8.5% tin, the remaining balance being copper. The alloy may have a 0.2% offset yield strength of at least 85 ksi, or at least 90 ksi, or at least 95 ksi. The alloy may have a low sliding coefficient of friction of about 0.3 or less (when measured by sliding against carbon steel), including 0.2 or less, and including about 0.175

In particular embodiments, the alloy of the coupling can have a 0.2% offset yield strength of at least 95 ksi and a Charpy V-notch impact energy of at least 22 ft-lbs at room temperature, and a low sliding coefficient of friction of 0.4 or less. Alternatively, the alloy of the coupling can have a 0.2% offset yield strength of at least 102 ksi and a Charpy V-notch impact energy of at least 12 ft-lbs at room temperature, and a low sliding coefficient of friction of 0.4 or less. Alternatively, the coupling can have a 0.2% offset yield strength of at least 120 ksi and a Charpy V-notch impact energy of at least 12 ft-lbs at room temperature, and a low sliding coefficient of friction of 0.4 or less.

The internal threads on the first end and the second end of the coupling can have the same box thread size. Alternatively, for a subcoupling, the internal threads on the first end and the second end can have different box thread sizes.

Sometimes, a bore runs through the core from the first end to the second end, the internal threads of each end being located within the bore. Each end of the coupling can also include a counterbore at an end surface.

The internal threads can be formed by roll forming. The internal threads of the coupling may have a Rockwell C hardness (HRC) of about 20 to about 40. The coupling can be formed by cold working and spinodal hardening.

In some embodiments of the coupling, the at least one groove runs parallel to a longitudinal axis extending from the first end to the second end. In other embodiments, the at least one groove runs spirally from the first end to the second end, or in other words curls around the exterior surface. The groove(s) can have an arcuate cross-section or a quadrilateral cross-section.

In particular embodiments, the first end and the second end of the coupling are tapered downwards (i.e. the diameter at each end is less than the diameter in the middle of the coupling). For example, the ends can be tapered linearly or parabolically.

Also disclosed herein are sucker rod strings, comprising: a first rod and a second rod, each rod including an end having a pin with an external thread; and a coupling having a structure as described above and herein. The internal thread of the first end of the coupling is complementary with the external thread of the first rod, and the internal thread of the second end of the coupling is complementary with the external thread of the second rod. Again, the coupling comprises a spinodally-hardened copper-nickel-tin alloy comprising from about 8 to about 20 wt % nickel, and from about 5 to about 11 wt % tin, the remaining balance being copper, wherein the alloy has a 0.2% offset yield strength of at least 75 ksi, and a low sliding coefficient of friction of 0.4 or less when measured against carbon steel.

Also disclosed herein are pump systems comprising: a downhole pump; a power source for powering the downhole pump; and a rod string located between the downhole pump and the power source; wherein the rod string comprises: a first rod and a second rod, each rod including an end having a pin with an external thread; and a coupling as described herein.

Also disclosed herein in various embodiments are couplings for a sucker rod, comprising a spinodally-hardened copper-nickel-tin alloy comprising from about 8 to about 20 wt % nickel, and from about 5 to about 11 wt % tin, the remaining balance being copper, wherein the alloy has a 0.2% offset yield strength of at least 75 ksi, and a low sliding coefficient of friction of 0.4 or less.

The copper-nickel-tin alloy can comprise, in more specific embodiments, about 14.5 wt % to about 15.5 wt % nickel, and about 7.5 wt % to about 8.5% tin, the remaining balance being copper. The alloy may have a 0.2% offset yield strength of at least 85 ksi, or at least 90 ksi, or at least 95 ksi.

In particular embodiments, the alloy of the coupling can have a 0.2% offset yield strength of at least 95 ksi and a Charpy V-notch impact energy of at least 22 ft-lbs at room temperature, and a low sliding coefficient of friction of 0.4 or less. Alternatively, the alloy of the coupling can have a 0.2% offset yield strength of at least 102 ksi and a Charpy V-notch impact energy of at least 12 ft-lbs at room temperature, and a low sliding coefficient of friction of 0.4 or less. Alternatively, the coupling can have a 0.2% offset yield strength of at least 120 ksi and a Charpy V-notch impact energy of at least 12 ft-lbs at room temperature, and a low sliding coefficient of friction of 0.4 or less.

Also disclosed herein are rod strings, comprising: a first rod and a second rod, each rod including an end having a pin with an external thread; and a coupling including a core having a first end and a second end, each end containing an internal thread; wherein the internal thread of the first end of the coupling is complementary with the external thread of the first rod, and the internal thread of the second end of the coupling is complementary with the external thread of the second rod; and wherein the coupling comprises a spinodally-hardened copper-nickel-tin alloy comprising from about 8 to about 20 wt % nickel, and from about 5 to about 11 wt % tin, the remaining balance being copper, wherein the alloy has a 0.2% offset yield strength of at least 75 ksi, and a low sliding coefficient of friction of 0.4 or less.

Also disclosed herein are pump systems comprising: a downhole pump; a power source for powering the downhole pump; and a rod string located between the downhole pump and the power source; wherein the rod string comprises: a first rod and a second rod, each rod including an end having a pin with an external thread; and a coupling including a core having a first end and a second end, each end containing an internal thread; wherein the internal thread of the first end of the coupling is complementary with the external thread of the first rod, and the internal thread of the second end of the coupling is complementary with the external thread of the second rod; and wherein the coupling comprises a spinodally-hardened copper-nickel-tin alloy comprising from about 8 to about 20 wt % nickel, and from about 5 to about 11 wt % tin, the remaining balance being copper, wherein the alloy has a 0.2% offset yield strength of at least 75 ksi, and a low sliding coefficient of friction of 0.4 or less.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
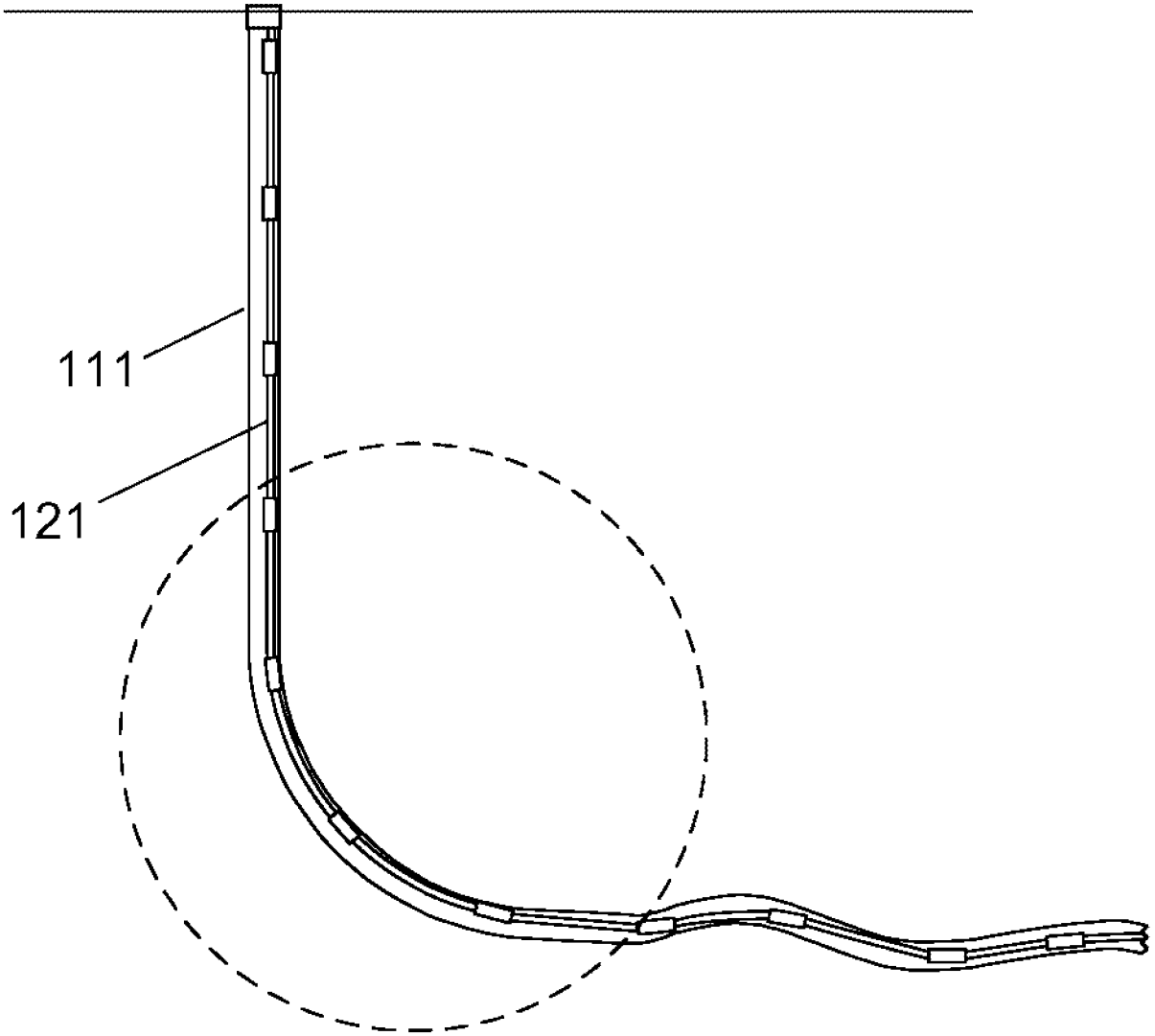
FIG. 1 is a schematic illustration of a deviated well.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named components/steps and permit the presence of other components/steps. However, such description should be construed as also describing compositions or processes as "consisting of" and "consisting essentially of" the enumerated components/steps, which allows the presence of only the named components/steps, along with any impurities that might result therefrom, and excludes other components/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The term "about" can be used to include any numerical value that can vary without changing the basic function of that value. When used with a range, "about" also discloses the range defined by the absolute values of the two endpoints, e.g. "about 2 to about 4" also discloses the range "from 2 to 4." The term "about" may refer to plus or minus 10% of the indicated number.

The terms "proximal" and "distal" are used herein to denote the location of two components relative to a center of a part. A component identified as "proximal" is closer to the center of the part than a "distal" component.

The terms "horizontal" and "vertical" are used to indicate direction relative to an absolute reference, i.e. ground level. "Vertical" refers to a direction away from the ground, while "horizontal" refers to a direction parallel to the ground. These terms should be construed in a lay sense.

The present disclosure relates to sucker rod strings made from a set of couplings which are made from a spinodally strengthened copper-based alloy. The copper alloys of the present disclosure may be copper-nickel-tin alloys that have a combination of strength, ductility, high strain rate fracture toughness, galling protection, and low friction (as measured by the sliding coefficient of friction against carbon steel). More particularly, the couplings are contemplated to be artificial lift couplings, sucker rod couplings, or subcouplings used in the oil and gas industry, particularly for hydrocarbon recovery systems.

The present disclosure also relates to couplings that are made from a spinodally strengthened copper-based alloy. The copper alloys of the present disclosure may be copper-nickel-tin alloys that have a combination of strength, ductility, high strain rate fracture toughness, and galling protection. More particularly, the couplings are contemplated to be artificial lift couplings, sucker rod couplings, or subcouplings used in the oil and gas industry, particularly for hydrocarbon recovery systems.

Figure 8:
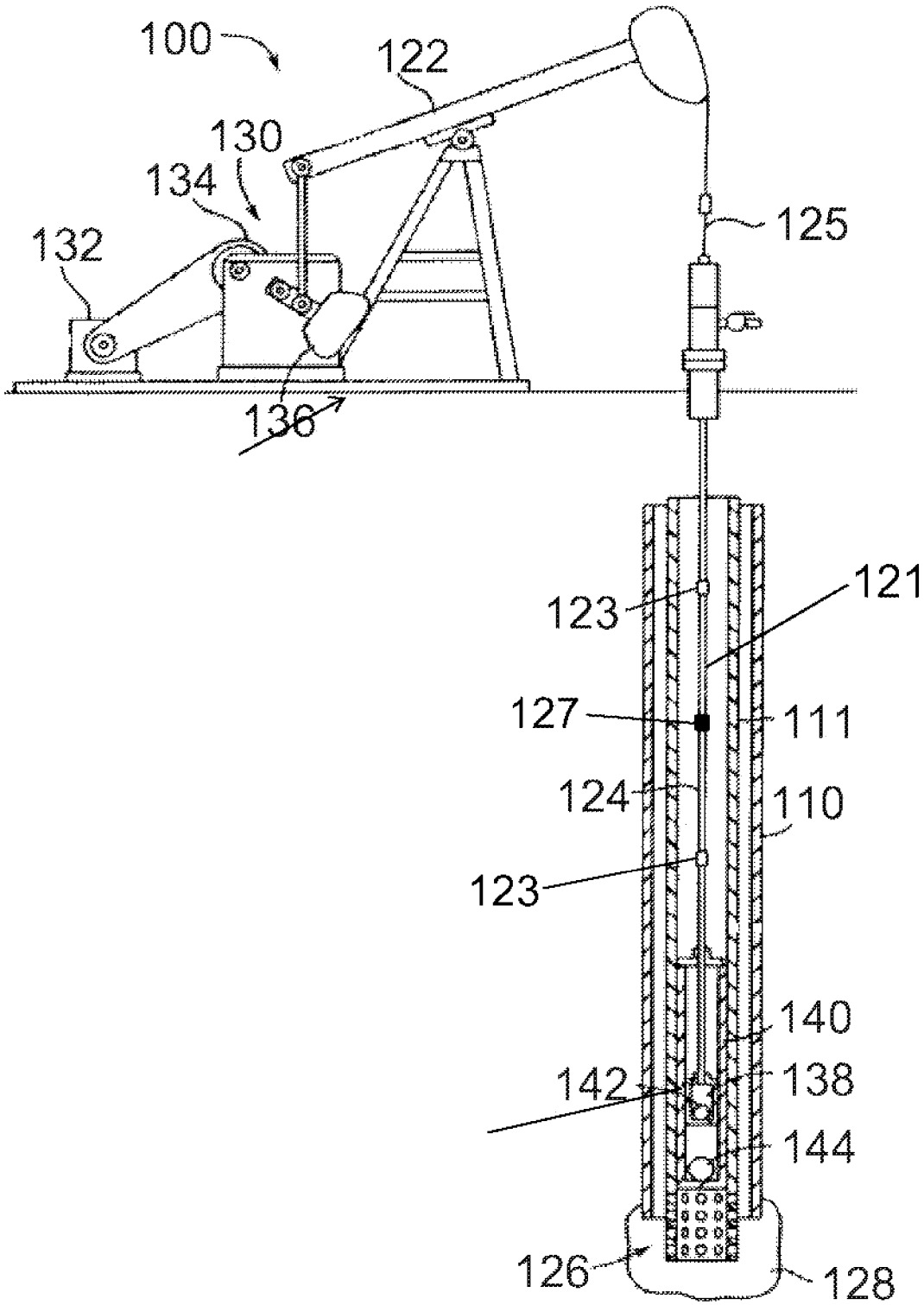
FIG. 8 is a schematic illustration of an embodiment of a vertical pumping system of the present disclosure.

By way of illustration, FIG. 8 shows the various parts of a pump system 100. The system 100 has a walking beam 122 that reciprocates a rod string 121 that includes a polished rod portion 125. The rod string 121 is suspended from the beam for actuating a downhole pump 126 that is disposed at the bottom of a well 128.

The walking beam 122, in turn, is actuated by a pitman arm which is reciprocated by a crank arm 130 driven by a power source 132 (e.g., an electric motor) that is coupled to the crank arm 130 through a gear reduction mechanism, such as gearbox 134. The power source may be a three-phase AC induction motor or a synchronous motor, and is used to drive the pumping unit. The gearbox 134 converts motor torque to a low speed but high torque output for driving the crank arm 130. The crank arm 130 is provided with a counterweight 136 that serves to balance the rod string 121 suspended from the beam 122. Counterbalance can also be provided by an air cylinder such as those found on air-balanced units. Belted pumping units may use a counterweight that runs in the opposite direction of the rod stroke or an air cylinder for counterbalance.

The downhole pump 126 may be a reciprocating type pump having a plunger 138 attached to the end of the rod string 121 and a pump barrel 140 which is attached to the end of tubing in the well 128. The plunger 138 includes a traveling valve 142 and a standing valve 144 positioned at the bottom of the barrel 140. On the up stroke of the pump, the traveling valve 142 closes and lifts fluid, such as oil and/or water, above the plunger 138 to the top of the well and the standing valve 144 opens and allows additional fluid from the reservoir to flow into the pump barrel 140. On the down stroke, the traveling valve 142 opens and the standing valve 144 closes in preparation of the next cycle. The operation of the pump 126 is controlled so that the fluid level maintained in the pump barrel 140 is sufficient to maintain the lower pump end of the rod string 121 in the fluid over its entire stroke. The rod string 121 is surrounded by a conduit or tubing 111 which in turn is surrounded by a well casing 110. The rod string 121 below the polished rod portion 125 is made of sucker rods 124 that are held together via sucker rod couplings 123. A sucker rod guide 127 may be attached to the sucker rod 124 in the sucker rod string 121 to guide and center the rods 121 in the conduit 111.

Conventional coupling geometries and materials cause rapid tubing wear due to contact between surfaces, combined with the elevated velocity of the well fluid as it exits the pump and flows through the clearance between the production tubing and the coupling between the valve rod bushing and the sucker rod. This wear on both the tubing and the sucker rod string is especially pronounced when the well is a deviated well (i.e. a well that travels horizontally as well as vertically), which can be produced by directional drilling.

Figure 2:
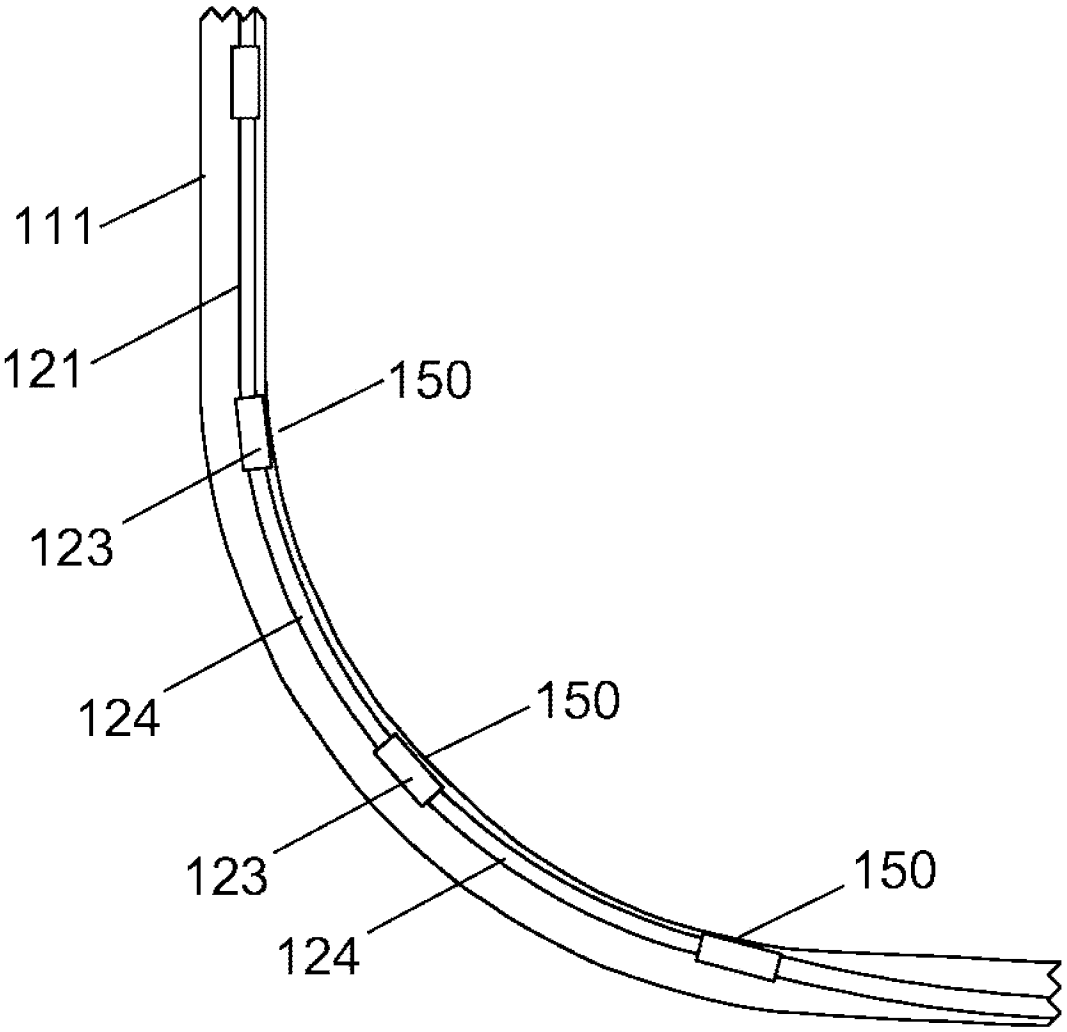
FIG. 2 is a magnified view of the kick off point (KOP) of the deviated well. The sucker rod couplings can be seen contacting the production tubing, which results in wear.

In this regard, FIG. 1 is an illustration of a deviated well. FIG. 2 is a magnified view of the kick off point. As seen in FIG. 1, the conduit/tubing 111 curves in a horizontal direction, and can rise up/down in a vertical direction as well, for example to follow a fluid reservoir. A deviated well can contain multiple curves, each of which can curve in a different direction. A sucker rod string 121 is located within the conduit.

As better seen in FIG. 2, the rod string 121 is made up of sucker rods 124 and sucker rod couplings 123. Due to the curvature of the deviated well, the sucker rods and couplings contact the inner wall of the conduit 111, as indicated here in locations 150. Mechanical friction in the system increases because the sucker rods, couplings, and the conduit/tubing rub and wear against each other. The sucker rod string may also bend and curve.

The use of the copper-nickel-tin alloys disclosed herein as the material for the sucker rod couplings, as well as potentially other components of the sucker rod string, reduces damage to the rod string due to galling-type wear between the rod string and the tubing. The sucker rod coupling can be made entirely out of the copper-nickel-tin alloy.

Additionally, the couplings of the present disclosure, being made from the copper-nickel-tin alloys disclosed herein, enable the couplings to act as a dampening device. The dampening is enabled because the copper alloys disclosed herein have a low elastic modulus compared to conventional materials. This phenomenon reduces the tendency of the mating surface of the upper components of the pump to become heavily cold worked during service. Such cold working can lead to loss of ductility and eventually to cracking, as well as the formation of "extruded" metal protrusions extending outward beyond the as-installed diameter of these components. These protrusions damage the inner diameter of the tubing and the production barrel of the pump. Metal fragments may be created as the protrusions fracture. These fragments can cause severe damage to the working surfaces of the pump and the tubing because they remain the system. The high modulus of resistance of the copper-nickel-tin alloys disclosed herein enables the coupling to perform this dampening function without plastically deforming. Rather, the coupling is able to return to its original dimensions after both compression on the downward stroke and tension in the upstroke. In other words, the coupling acts as a solid spring.

The use of copper-nickel-tin alloys in the sucker rod strings will result in less power usage (a minimum of 3% reduction) as well as enhanced pump capacity (up to a 40% increase in output). The alloys have a combination of low coefficient of friction; high toughness (CVN); high tensile strength; high corrosion resistance; and high wear resistance. The unique combination of properties protects the sucker rod couplings and their associated sucker rod strings from galling damage and wear damage, thereby greatly extending the lifetime of the system and reducing the risk of unanticipated failure. One result is longer well life between maintenance shutdowns. In addition, overall production is enhanced due to the reduced friction.

As mentioned above, the copper-based alloys of the present disclosure have a low sliding coefficient of friction. In some embodiments, the copper-based alloy in contact with carbon steel, has a sliding coefficient of friction of less than 0.4. In other embodiments, the copper-based alloy has a sliding coefficient of about 0.3 or less, including about 0.2 or less.

Figure 5:
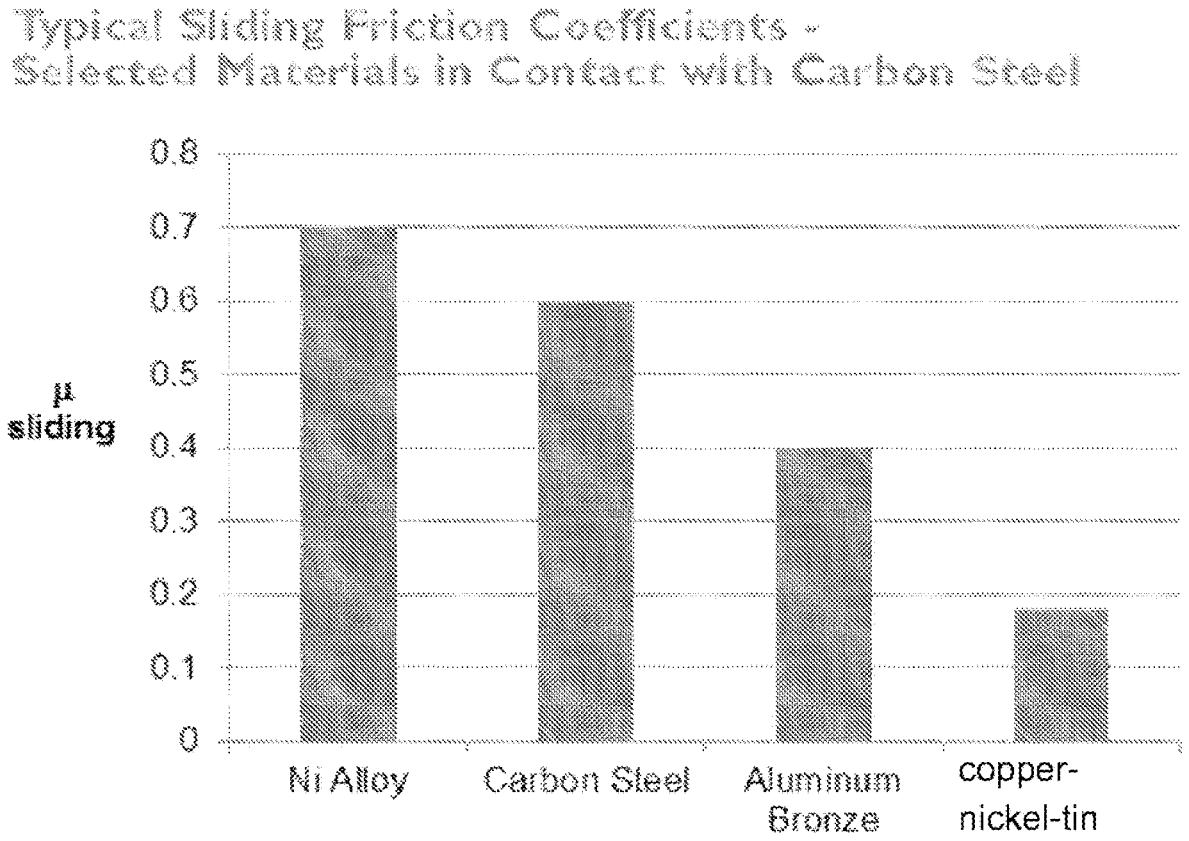
FIG. 5 is a graph illustrating typical sliding friction coefficients of various materials measured by sliding the material on carbon steel.

In particular embodiments of the present disclosure, a copper-nickel-tin alloy (such as ToughMet® 3) in contact with carbon steel typically has a sliding coefficient of less than 0.2 (including about 0.175 or less). In contrast, a nickel alloy in contact with carbon steel typically has a sliding coefficient of friction of 0.7. Carbon steel in contact with carbon steel typically has a sliding coefficient of 0.6 and aluminum bronze in contact with carbon steel typically has a sliding coefficient of 0.4. The comparison of these values are illustrated in the graph of FIG. 5. Thus, it is possible to significantly reduce overall frictional losses in the pumping system.

Figure 6:
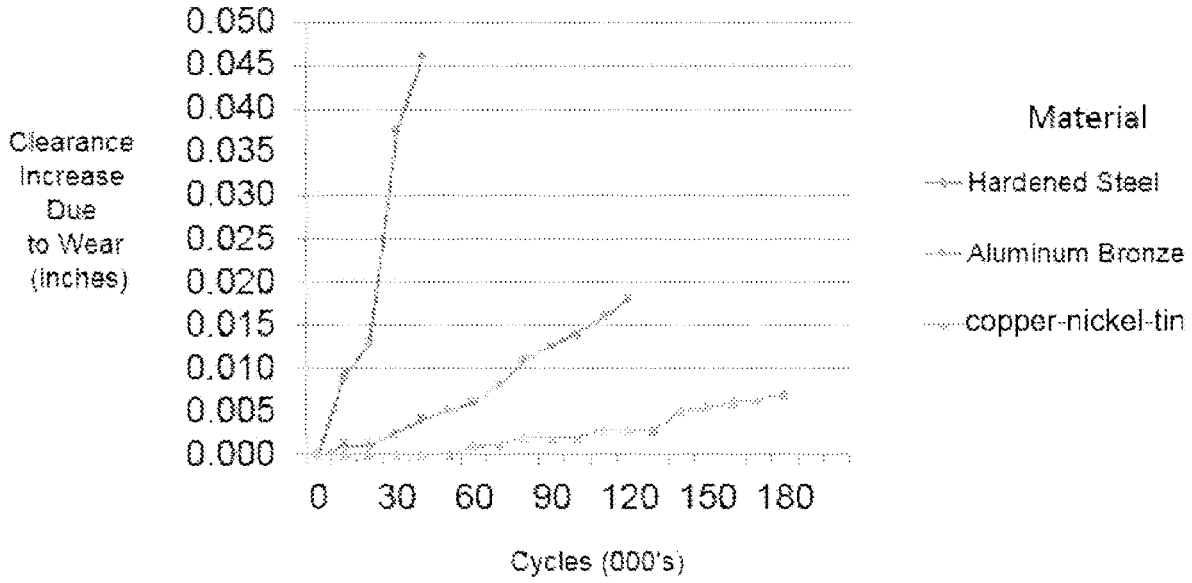
FIG. 6 is a graph illustrating the wear of various materials against a steel shaft.

The reduction in friction also results in less tubing wear. FIG. 6 is a graph showing the use of three different metals used in bearings in contact with a carburized steel shaft with an average bearing stress at 2,000 psi. The y-axis indicates the change in clearance due to wear, with a lower value indicating less wear. As seen here, the copper-nickel-tin alloy wore less (triangles, below 0.010 inches) than aluminum bronze (squares, between 0.015 and 0.020 inches) and hardened steel (diamonds, more than 0.045 inches). It has been calculated that by using 50 such sucker rod couplings in a well, annual additional cash flow could range substantially from $50,000 to $183,000, or even more.

Some particular arrangements of the copper-nickel-tin alloy sucker rod couplings are contemplated within the sucker rod strings. Initially, it is contemplated that only some of the sucker rod couplings used in the entire sucker rod string are made from the copper-nickel-tin alloys described herein. The remainder of the sucker rod couplings can be made from standard materials such as Class SM steel sucker rod couplings. Put another way, the sucker rod string includes a set of sucker rod couplings, which includes all of the sucker rod couplings in the sucker rod string, and only a plurality of the couplings in the set are copper-nickel-tin couplings. Another way of saying this is the set of couplings may include (a) the plurality of couplings made from the copper-nickel-tin alloy; and (b) a plurality of non-copper couplings.

Figure 7A:
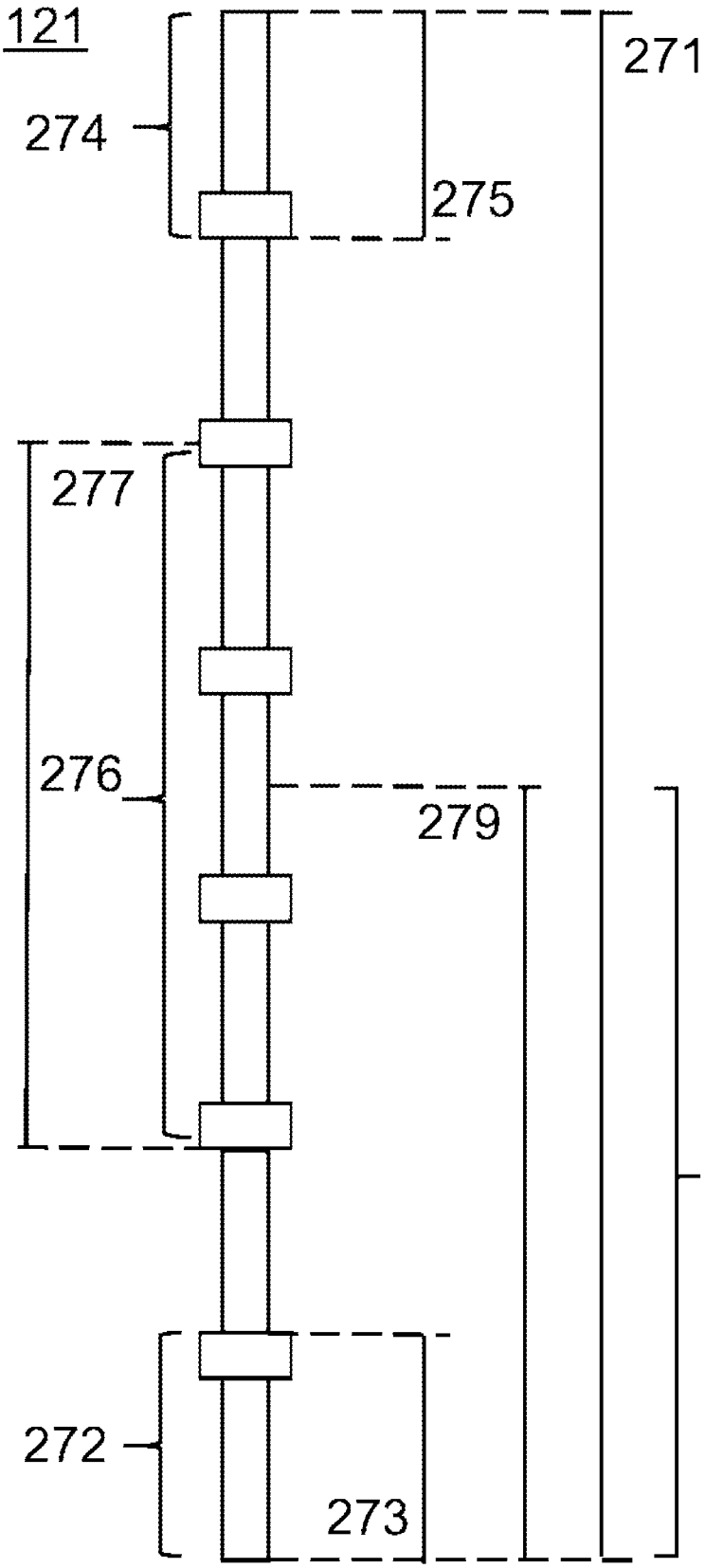
FIG. 7A is a diagram of a sucker rod string, identifying various portions of the sucker rod string.

Next, the plurality of couplings made from the copper-nickel-tin alloy may be located in (1) a lower pump end of the sucker rod string; (2) an upper motor end of the sucker rod string; (3) a center section of the sucker rod string; or (4) a bottom section of the sucker rod string. These locations are illustrated in FIG. 7A, which is a diagrammatic representation of the entire sucker rod string 121. The sucker rod string has a length 271. The lower pump end 272 of the sucker rod string is defined by the bottom 15% of the length of the sucker rod string (reference numeral 273). The upper motor end 274 of the sucker rod string is defined by the top 15% of the length of the sucker rod string (reference numeral 275). The center section 276 of the sucker rod string is defined by the middle 50% of the length of the sucker rod string (reference numeral 277). The bottom section 278 of the sucker rod string is defined by the bottom 50% of the length of the sucker rod string (reference numeral 279).

Figure 7B:
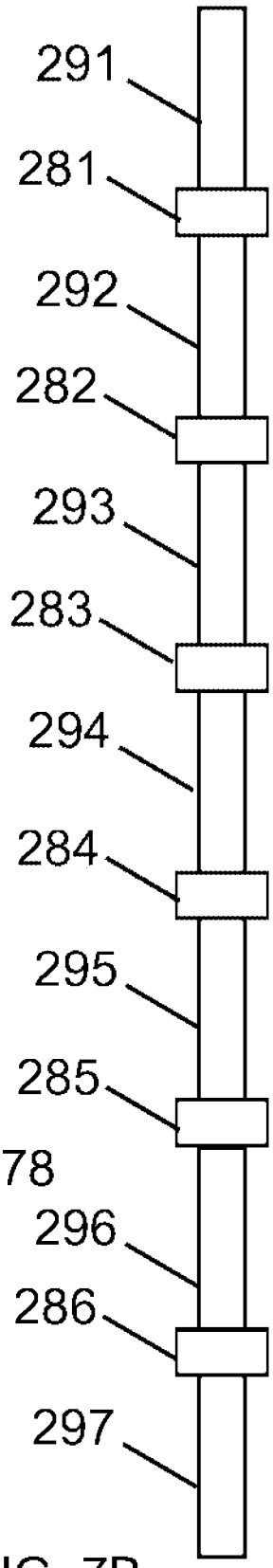
FIG. 7B is a diagram of a section of sucker rods and sucker rod couplings, used to identify various relationships between the sucker rod couplings.

Multiple sucker rod couplings may be located in these lengths of the sucker rod string. In further embodiments, it is contemplated that at least 50% of the couplings in a lower pump end, an upper motor end, a center section, or a bottom section of the sucker rod string are made from the copper-nickel-tin alloy. This may include 100% of the couplings in these lengths of the sucker rod string. This is illustrated in FIG. 7B, which is a diagrammatic representation of a small part of the sucker rod string. Illustrated here are seven sucker rods 291, 292, 293, 294, 295, 296, 297. A sucker rod coupling 281, 282, 283, 284, 285, 286 joins each pair of adjacent sucker rods.

In some embodiments, the couplings made from the copper-nickel-tin alloy could be alternated with the non-copper couplings. For example, couplings 281, 283, 285 would be made from the copper-nickel-tin alloy, whereas couplings 282, 284, 286 would be couplings made from standard materials (such as steel). This is also an example where at least 50% of the couplings are made from the copper-nickel-tin alloy.

Alternatively, all of the couplings 281, 282, 283, 284, 285, 286 could be made from the copper-nickel-tin alloy.

The sucker rod string can include at least 5 couplings, or at least 10 couplings, or from 10 to 15 couplings, or from 25 to 40 couplings, or at least 55 couplings, that are made from the copper-nickel-tin alloy. It is contemplated that these numbers may be the minimum useful number in certain lengths of the sucker rod string, such as highly deviated lengths. In other embodiments, at least 5%, at least 10%, or at least 20%, or at least 25%, or at least 50%, or 100% of the couplings in the set of couplings are made from the copper-nickel-tin alloy.

Figure 3:
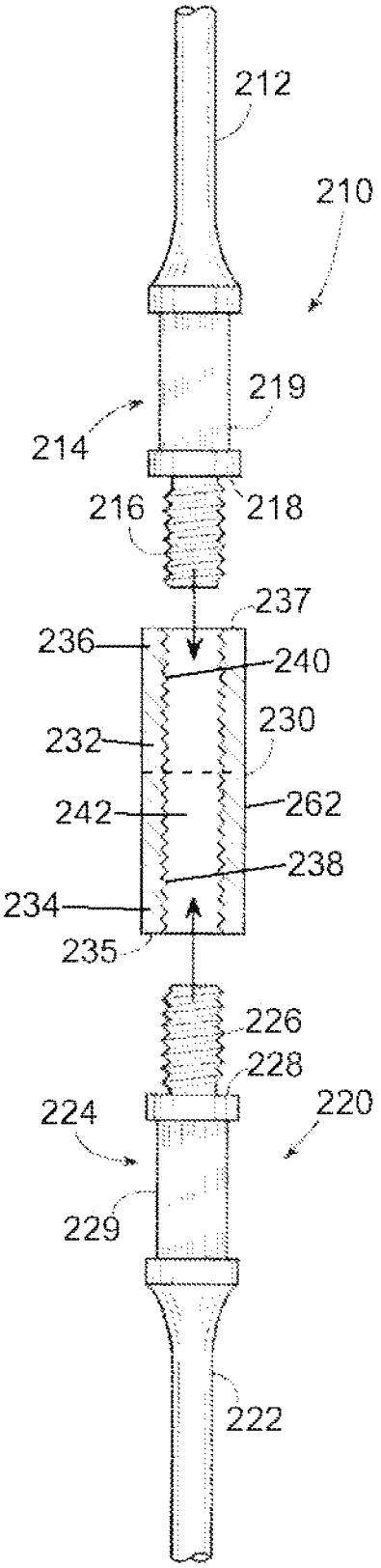
FIG. 3 is a cross-sectional view showing the engagement of a sucker rod coupling with two sucker rods.

FIG. 3 is a side view illustrating the engagement between two sucker rods 210, 220 and a sucker rod coupling. Each sucker rod 210, 220 includes a rod body 212, 222 and two rod ends 214, 224 (only one end shown for each rod). The rod end includes an externally-threaded pin (or male connector) 216, 226; a shoulder 218, 228 adapted to abut the end surface of the coupling; and a drive head 219, 229 which can be engaged by a tool for torquing and tightening the sucker rods. At each rod end, the pin is located distal to the drive head, which is also located distal to the shoulder (relative to the rod body). The sucker rod is solid, i.e. there are no bores running between the two rod ends. Generally, a sucker rod is between 25 and 30 feet (7 to 9 meters) in length and have a diameter of 0.625, 0.75, 0.875, 1.0, or 1.25 inches. Pony rods have the same structure as a sucker rod, but have lengths of 2 feet to 10 feet.

The sucker rod coupling 230 itself is a core 232 having a first end 234 and a second end 236, each end corresponding to a box and having an internal thread (i.e. a female connector) 238, 240 for engaging the pin of a sucker rod. The core has a generally cylindrical shape, with the length being greater than the diameter. Each end has an end surface 235, 237 that abuts the shoulder of the sucker rod. As illustrated here, a bore 242 runs entirely through the core from the first end 234 to the second end 236 along the longitudinal axis of the core. Both internal threads 238, 240 are located on the surface of the bore, and a dotted line indicates where the two ends meet in the center of the core. Here, both internal threads have the same box thread size, and are complementary to the external threads on the sucker rods. The dimensions of the sucker rods and the various parts of the sucker rod coupling are defined by API Specification 11B, the 27th edition of which was issued in May 2010.

Figure 20A:
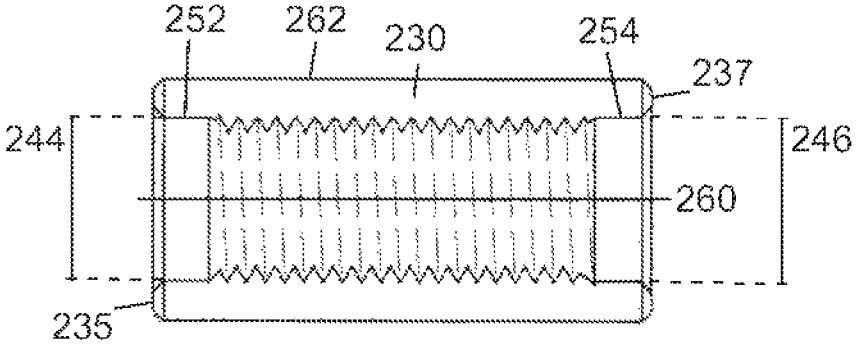
FIG. 20A is a cross-sectional view showing the interior of a sucker rod coupling.
Figure 20B:
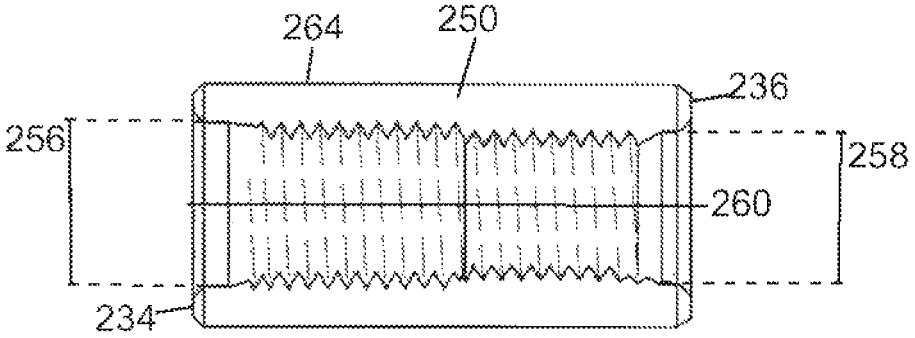
FIG. 20B is a cross-sectional view showing the interior of a subcoupling.

FIG. 20A provides a cross-sectional view of a sucker rod coupling 230, FIG. 20B is a cross-sectional view of a subcoupling 250. The sucker rod coupling 230 of FIG. 20A includes a counterbore 252, 254 at each end surface 235, 237. Put another way, the internal thread does not run all the way to the end surface as in FIG. 3. Here, both internal threads have the same box thread size as indicated by reference numerals 244, 246. The longitudinal axis is also indicated by line 260.

The subcoupling 250 in FIG. 20B has the same structure as the sucker rod coupling, but differs in that the box thread size of the first end 234 is different from the box thread size of the second end 236, as indicated by reference numerals 256, 258. The longitudinal axis is also indicated by line 260.

In particular embodiments, the sucker rod coupling 230 of FIG. 3 and FIG. 20A, and the subcoupling 250 of FIG. 20B have substantially smooth curved exterior surfaces 262 and 264, respectively. In other words, the outer diameter remains constant along the length of these couplings such that curved exterior surfaces 262 and 264 are uniform. In particular embodiments, the outer diameter of these couplings is not significantly greater in diameter compared to the outer diameter of the sucker rods.

Figure 21:
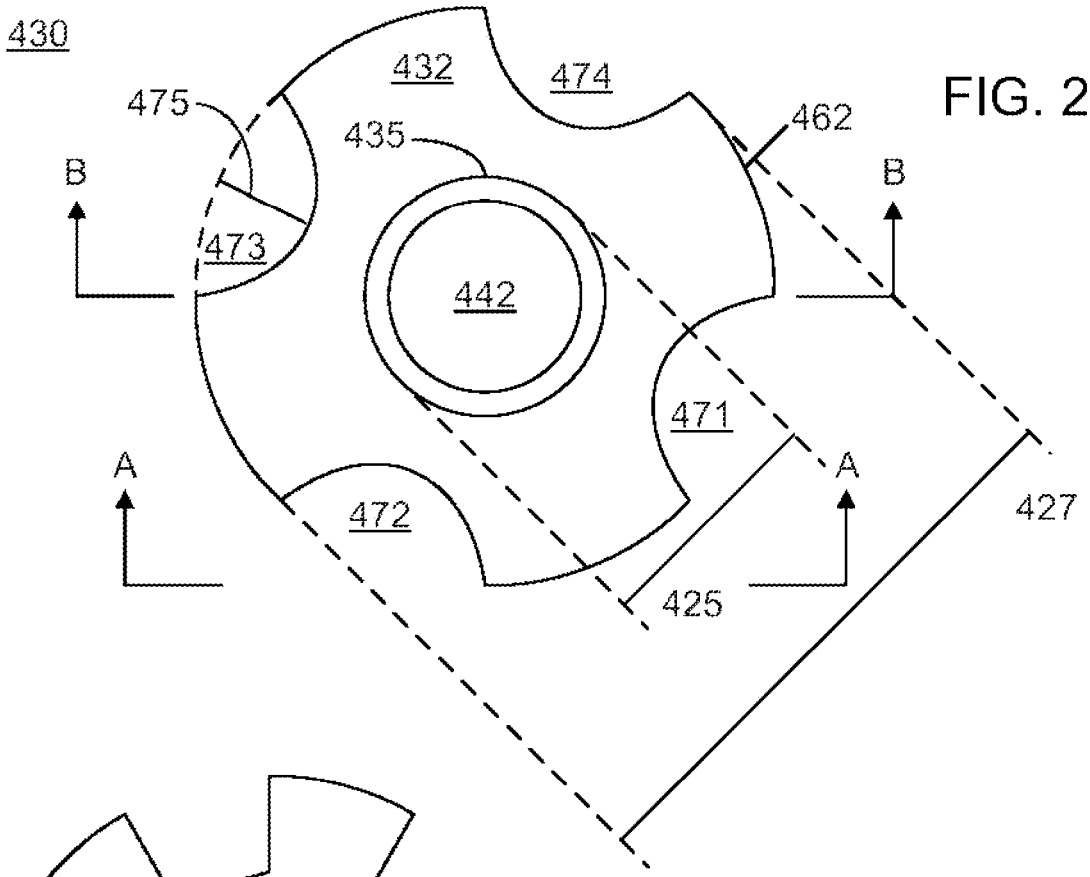
FIG. 21 is a plan view (i.e. looking down the longitudinal axis) of an exemplary sucker rod coupling of the present disclosure, having four grooves on the exterior surface of the core. The grooves have an arcuate cross-section.
Figure 22:
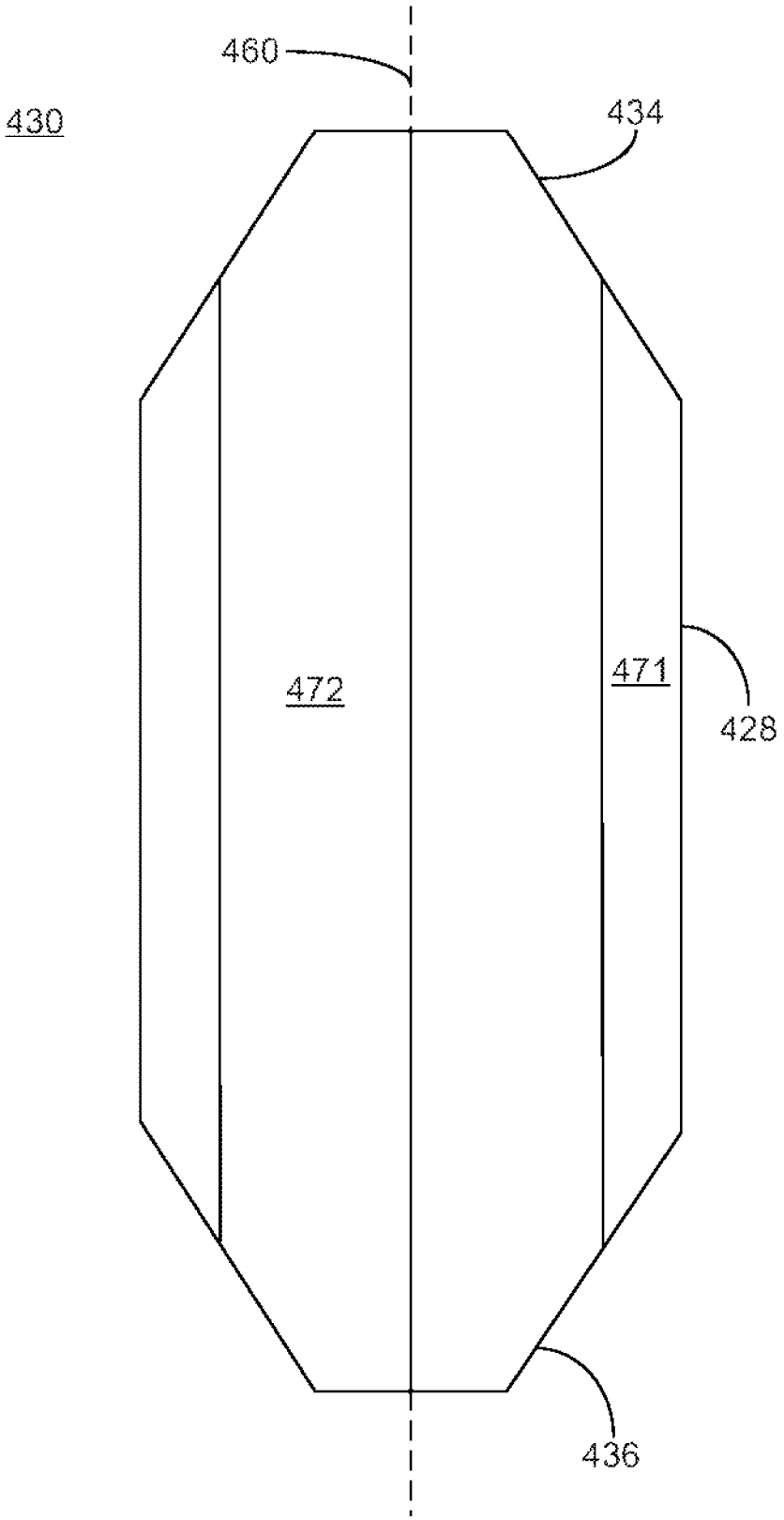
FIG. 22 is a side exterior view of the coupling taken along plane AA of FIG. 21. The grooves run parallel to a longitudinal axis extending between the two ends of the coupling. The ends of the coupling are linearly tapered.
Figure 23:
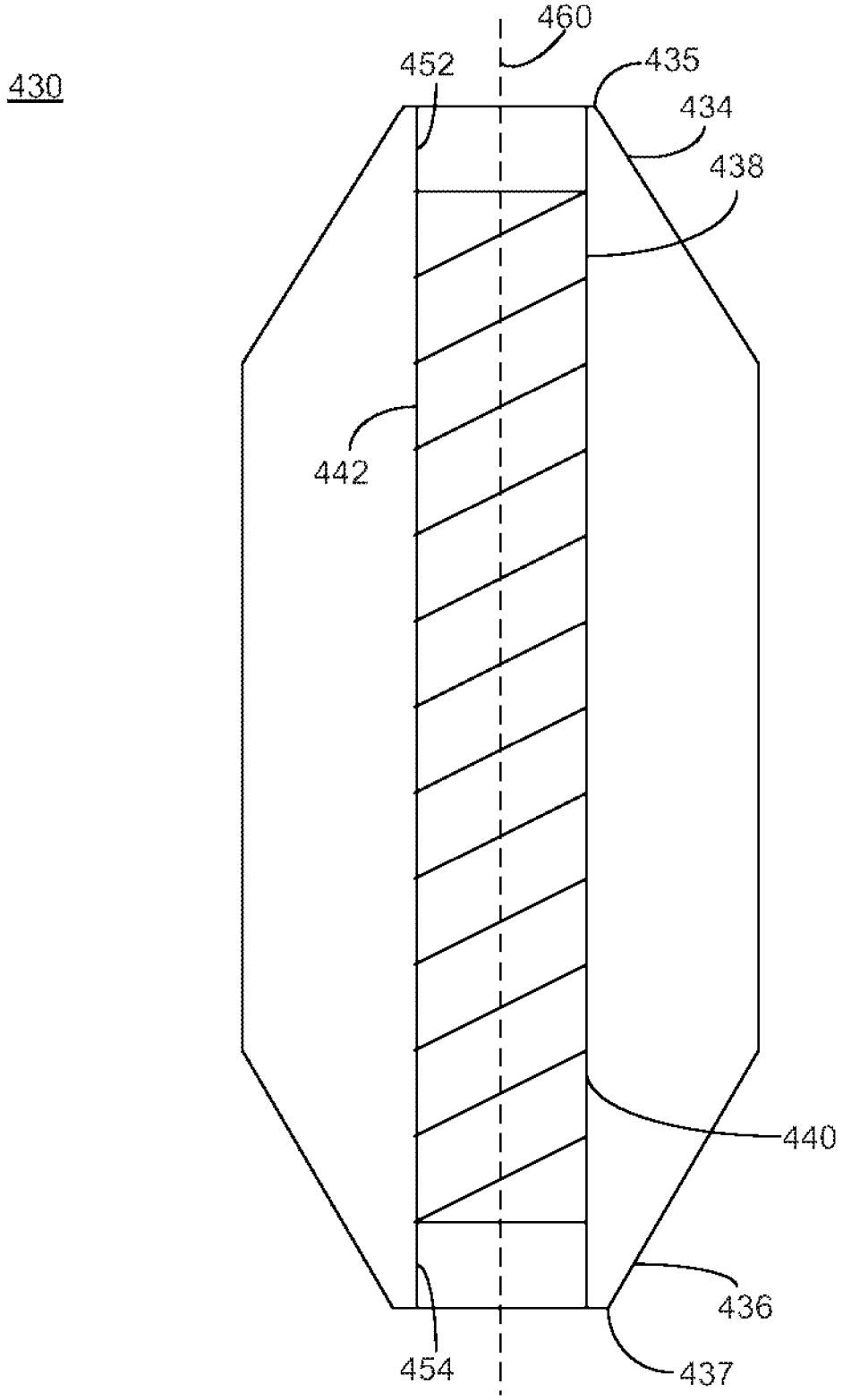
FIG. 23 is a side cross-sectional view of the coupling taken along plane BB of FIG. 21. This coupling includes a counterbore and internal threads.

Additional variations on such couplings are disclosed in FIGS. 21-23. More particularly, the outer diameter of these couplings is greater than the outer diameter of the sucker rods. This prevents the sucker rods from contacting the production tubing (e.g. conduit 111 of FIG. 8) surrounding the rod string. FIG. 21 is a plan view. FIG. 22 is an exterior view taken along plane AA of FIG. 21. FIG. 23 is a cross-sectional view taken along plane BB of FIG. 21.

Referring first to FIG. 21, the coupling 430 is formed from a core 432. The cross-section of the core has a generally circular shape, with a bore 442 running entirely through the core along the longitudinal axis. The exterior surface 462 of the core has at least one groove. Here, four grooves 471, 472, 473, 474 are shown. The core has an inner diameter 425 that also corresponds to the diameter of the bore, and the core also has an outer diameter 427. Each groove has a depth 475, which is measured relative to the outer diameter of the core. Each groove may have any desired depth, and there may be any number of grooves as well, as long as sufficient material remains of the core to support the rods that are joined to the coupling. In particular embodiments, the ratio of the groove depth 475 is at most one-half of the difference between the outer diameter 427 and the inner diameter 425. In particular embodiments, there is a plurality of grooves, and the grooves are generally spaced evenly around the perimeter of the core.

It is contemplated that the coupling desirably contacts any production tubing instead of the sucker rods doing so, so as to reduce wear on the sucker rods. One means of doing this is to increase the outer diameter of the sucker rod coupling. However, this could impede fluid flow within the production tubing. The presence of the grooves provides a path for fluid flow, reducing the cross-sectional area of the coupling and reducing any impedance in fluid flow due to the use of the coupling.

Referring now to the exterior view of FIG. 22, the coupling has a first end 434 and a second end 436, and a middle 428. The first end 434 and the second end 436 taper downwards, i.e. the diameter at the middle 428 is greater than the diameter at each end of the coupling. The term "taper" here refers only to the diameter decreasing from the middle to each end, and does not require the change in diameter to occur in any given manner. Here in FIG. 22, the ends of the core taper linearly, i.e. in a straight line. Grooves 471 and 472 are visible as well. Longitudinal axis 460 is also drawn for reference (dashed line).

Referring now to the cross-sectional view of FIG. 23, each end of the coupling 434, 436 corresponds to a box and has an internal thread (Le. a female connector) 438, 440 for engaging the pin of a sucker rod. Each end has an end surface 435, 437 that abuts the shoulder of the sucker rod. The bore 442 runs entirely through the core from the first end 434 to the second end 436 along the longitudinal axis 460 of the core. Both internal threads 438, 440 are located on the surface of the bore. Here, both internal threads have the same box thread size. A counterbore 452, 454 is present at each end 434, 436, where the internal thread does not run all the way to the end surface.

Figure 24:
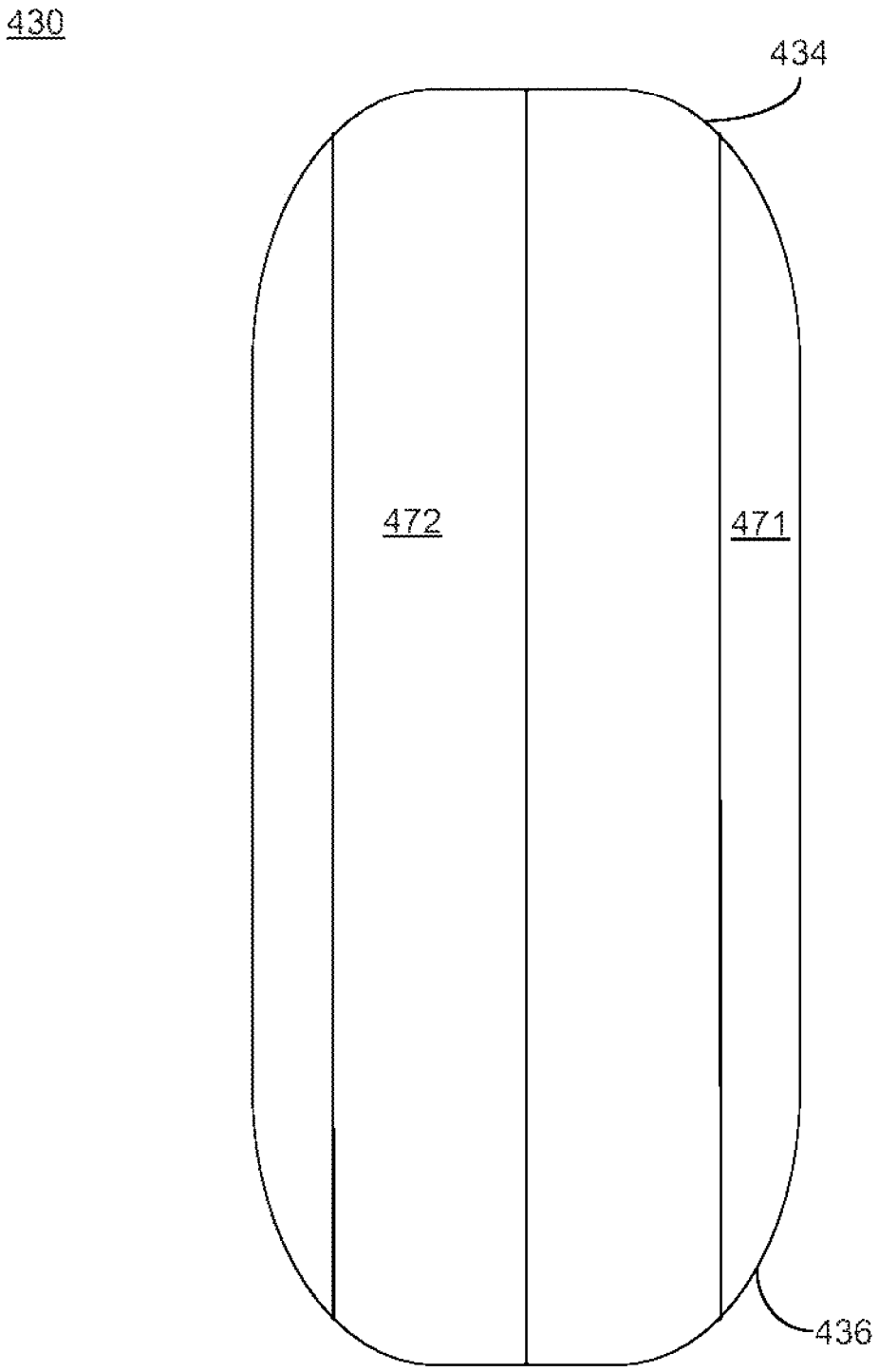
FIG. 24 is a side exterior view of another coupling taken along plane AA of FIG. 21. This coupling has the same plan view, but the exterior view is different. Here, the ends of the coupling are parabolically tapered.

FIG. 24 is another embodiment of a sucker rod coupling. Here, the coupling 430 has the same plan view as illustrated in FIG. 21, but the ends 434, 436 are tapered parabolically instead of linearly. The transition from the middle to each end is arcuate, when viewed from the side. Grooves 471 and 472 are still visible.

Figure 25:
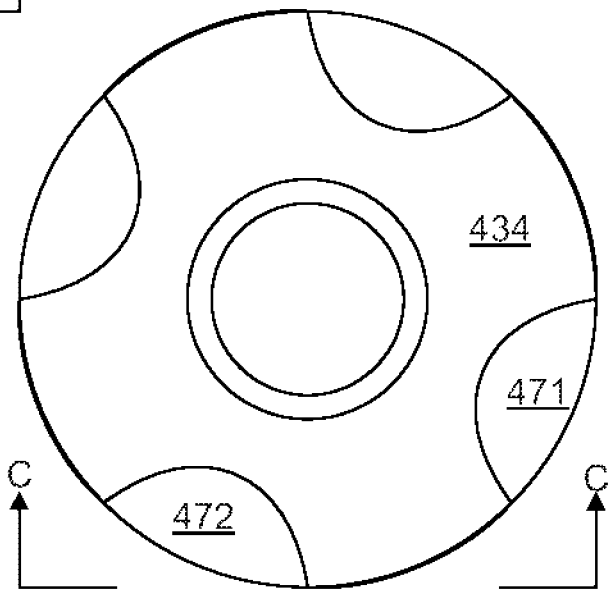
FIG. 25 is a plan view of another sucker rod coupling of the present disclosure, having four grooves on the exterior surface of the core. The grooves have a spiral or helical cross-section.
Figure 26:
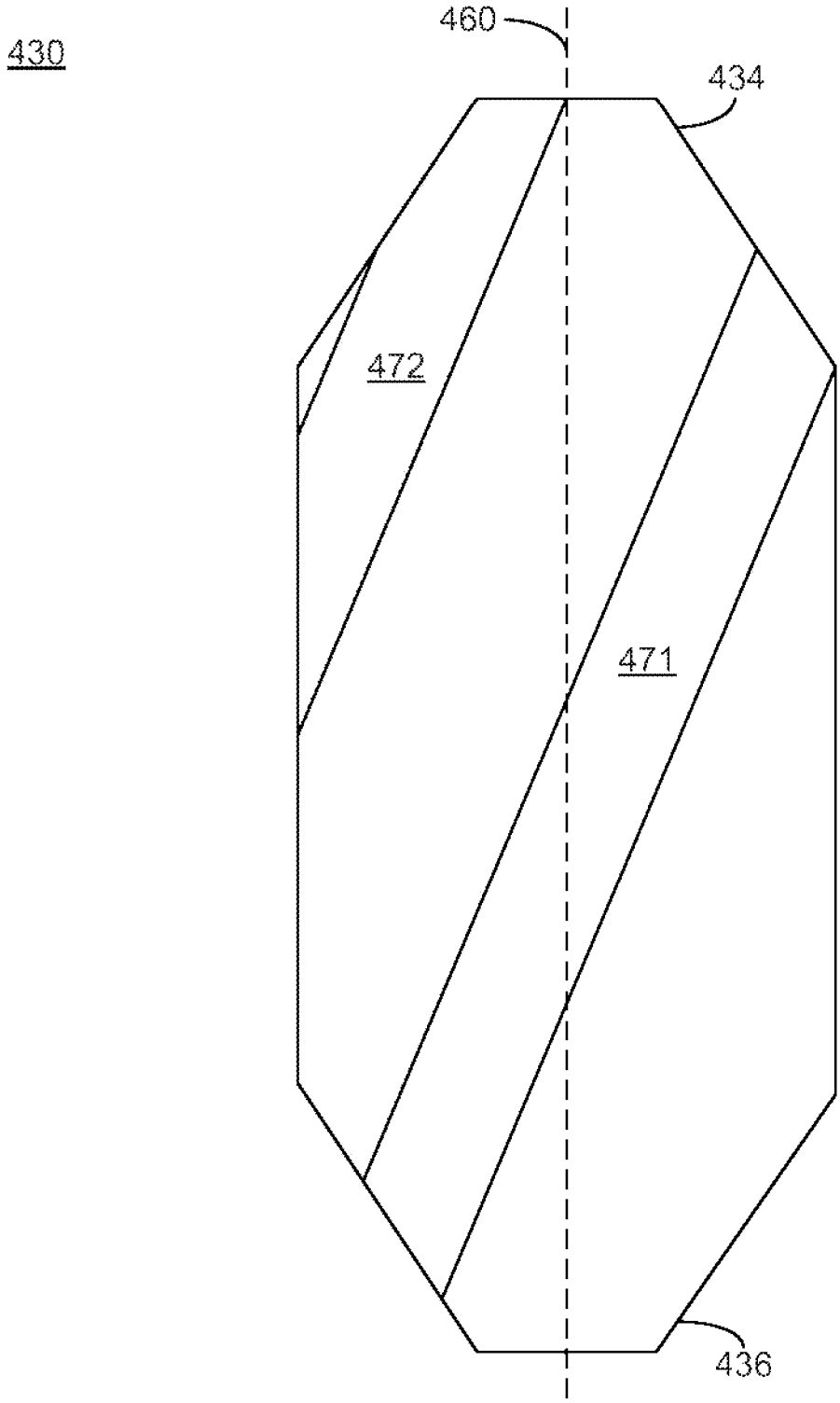
FIG. 26 is a side exterior view of the coupling taken along plane CC of FIG. 25. The grooves have a spiral cross-section, i.e. are angled relative to the longitudinal axis extending between the two ends of the coupling. The ends of the coupling are linearly tapered.

FIG. 25 and FIG. 26 illustrate another aspect of the present disclosure. FIG. 25 is the plan view, and FIG. 26 is the side view taken along plane CC of FIG. 25. Here, the grooves do not run parallel to the longitudinal axis 460. Rather, the grooves 471, 472 run spirally from the first end 434 to the second end 436, or put another way from one side of the perimeter to the other side of the perimeter, similar to threads on a screw. The distance along the longitudinal axis that is covered by one complete rotation of a groove (also called the lead) can be varied as desired.

Figure 27:
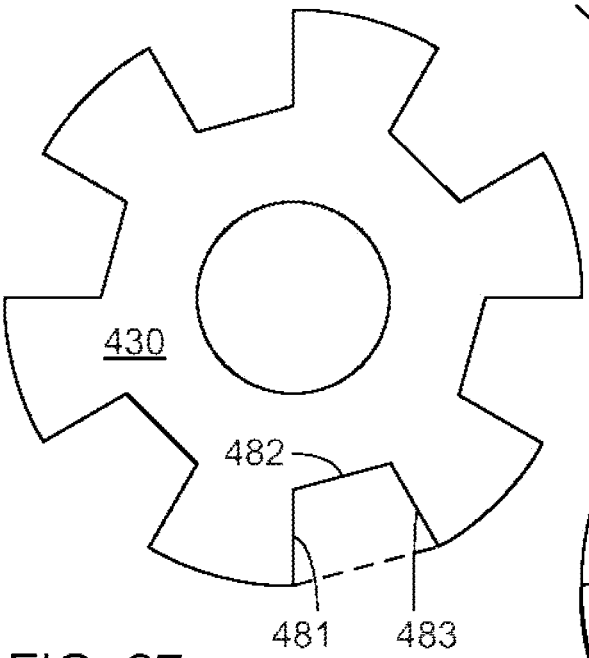
FIG. 27 is a plan view of another sucker rod coupling of the present disclosure, having six grooves on the exterior surface of the core. The grooves have a quadrilateral cross-section.

Finally, FIG. 27 illustrates yet another aspect of the present disclosure. The cross-section of the groove can vary as desired, again as long as sufficient material remains of the core 430 to support the rods that are joined to the coupling. Here in FIG. 27, the groove 471 has a quadrilateral cross-section formed from three sides 481, 482, 483 (the fourth side is the perimeter of the core indicated by a dotted line). In contrast, the grooves of FIG. 21 have an arcuate cross-section.

In particular embodiments, the sucker rod coupling 230 has substantially smooth curved exterior surfaces 262, respectively. In other words, the outer diameter remains constant along the length of these couplings such that curved exterior surface 262 is uniform. In particular embodiments, the outer diameter of these couplings is not significantly greater in diameter compared to the outer diameter of the sucker rods.

Figure 4:
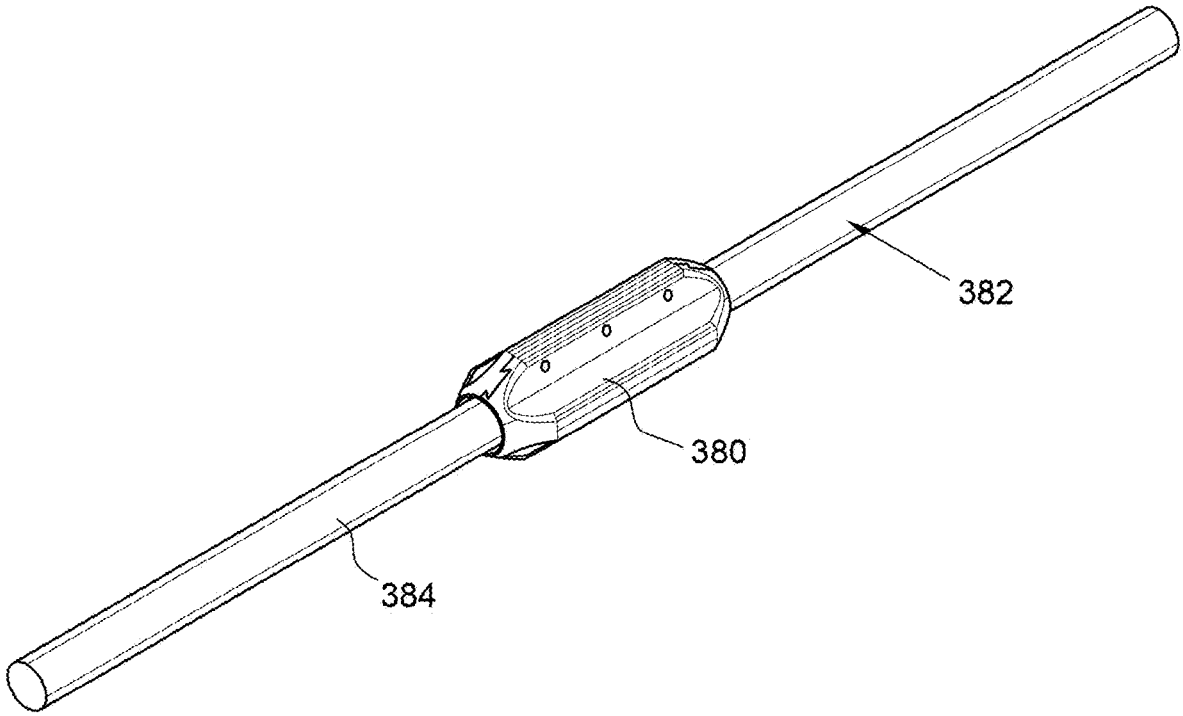
FIG. 4 is an illustration of a sucker rod including a sucker rod guide.

In some embodiments, a sucker rod guide is attached to a sucker rod for additional protection against contact with the tubing/casing. FIG. 4 is a perspective view of a sucker rod guide 380 attached to a sucker rod 382. The sucker rod 382 has an outer surface 384 in contact with an interior surface (not visible) of the sucker rod guide 380. Again, the sucker rod guide has an outer diameter that is greater than the outer diameter of the sucker rod. The sucker rod guide 380 aids in centering the sucker rod 382 in the conduit, helping to prevent wear to the sucker rod string during operation.

Generally, the copper alloy used to form the couplings of the present disclosure has been cold worked prior to reheating to affect spinodal decomposition of the microstructure. Cold working is the process of mechanically altering the shape or size of the metal by plastic deformation. This can be done by rolling, drawing, pressing, spinning, extruding or heading of the metal or alloy. When a metal is plastically deformed, dislocations of atoms occur within the material. Particularly, the dislocations occur across or within the grains of the metal. The dislocations over-lap each other and the dislocation density within the material increases. The increase in over-lapping dislocations makes the movement of further dislocations more difficult. This increases the hardness and tensile strength of the resulting alloy while generally reducing the ductility and impact characteristics of the alloy. Cold working also improves the surface finish of the alloy. Mechanical cold working is generally performed at a temperature below the recrystallization point of the alloy, and is usually done at room temperature.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

Spinodal alloys, in most cases, exhibit an anomaly in their phase diagram called a miscibility gap. Within the relatively narrow temperature range of the miscibility gap, atomic ordering takes place within the existing crystal lattice structure. The resulting two-phase structure is stable at temperatures significantly below the gap.

The copper-nickel-tin alloy utilized herein generally includes from about 9.0 wt % to about 15.5 wt % nickel, and from about 6.0 wt % to about 9.0 wt % tin, with the remaining balance being copper. This alloy can be hardened and more easily formed into high yield strength products that can be used in various industrial and commercial applications.

More particularly, the copper-nickel-tin alloys of the present disclosure include from about 9 wt % to about 15 wt % nickel and from about 6 wt % to about 9 wt % tin, with the remaining balance being copper. In more specific embodiments, the copper-nickel-tin alloys include from about 14.5 wt % to about 15.5% nickel, and from about 7.5 wt % to about 8.5 wt % tin, with the remaining balance being copper.

Ternary copper-nickel-tin spinodal alloys exhibit a beneficial combination of properties such as high strength, excellent tribological characteristics, and high corrosion resistance in seawater and acid environments. An increase in the yield strength of the base metal may result from spinodal decomposition in the copper-nickel-tin alloys.

The copper alloy may include beryllium, nickel, and/or cobalt. In some embodiments, the copper alloy contains from about 1 to about 5 wt % beryllium and the sum of cobalt and nickel is in the range of from about 0.7 to about 6 wt %. In specific embodiments, the alloy includes about 2 wt % beryllium and about 0.3 wt % cobalt and nickel. Other copper alloy embodiments can contain a range of beryllium between approximately 5 and 7 wt %.

In some embodiments, the copper alloy contains chromium. The chromium may be present in an amount of less than about 5 wt % of the alloy, including from about 0.5 wt % to about 2.0 wt % or from about 0.6 wt % to about 1.2 wt % of chromium.

In some embodiments, the copper alloy contains silicon. The silicon may be present in an amount of less than 5 wt %, including from about 1.0 wt % to about 3.0 wt % or from about 1.5 wt % to about 2.5 wt % of silicon.

The alloys of the present disclosure optionally contain small amounts of additives (e.g., iron, magnesium, manganese, molybdenum, niobium, tantalum, vanadium, zirconium, aluminum, zinc, and mixtures thereof). The presence of the additives may have the effect of further increasing the strength of the resulting alloy. The additives may be present in total amounts of up to 1 wt %, suitably up to 0.5 wt %. Furthermore, small amounts of natural impurities may be present.

In some embodiments, some magnesium is added during the formation of the initial alloy in order to reduce the oxygen content of the alloy. Magnesium oxide is formed which can be removed from the alloy mass. Iron may be added as a grain refiner, and up to 0.2 wt % iron may be present in the final alloy.

In particular embodiments, the internal threads of the coupling are formed by roll forming, rather than by cutting. This process appears to elongate the grains on the outer surface of the threads. Rolled threads have been found to resist stripping because shear failures must take place across the grain, rather than with the grain. This cold working process also provides additional strength and fatigue resistance. As a result, the internal threads may have a Rockwell C hardness (HRC) of about 20 to about 40. The HRC can vary throughout the thread, and this recitation should not be construed as requiring the entire thread to have the same HRC. In particular embodiments, the HRC of the thread is a minimum of 22. The outer surface of the thread may have an HRC of at least 35.

The alloys used for making the couplings of the present disclosure may have a 0.2% offset yield strength of at least 75 ksi, including at least 85 ksi, or at least 90 ksi, or at least 95 ksi.

The alloys used for making the couplings of the present disclosure may have a combination of 0.2% offset yield strength and room temperature Charpy V-Notch impact energy as shown below in Table 1. These combinations are unique to the copper alloys of this disclosure. The test samples used to make these measurements were oriented longitudinally. The listed values are minimum values (i.e. at least the value listed), and desirably the offset yield strength and Charpy V-Notch impact energy values are higher than the combinations listed here. Put another way, the alloys have a combination of 0.2% offset yield strength and room temperature Charpy V-Notch impact energy that are equal to or greater than the values listed here.

TABLE 1

| 0.2% Offset Yield Strength (ksi) | Ultimate Tensile Strength (ksi) | Elongation at break (%) | Room Temperature Charpy V-Notch Impact Energy (ft-lbs) | Preferred Room Temperature Charpy V-Notch Impact Energy (ft-lbs) |
|---|---|---|---|---|
| 120 | 120 | 15 | 12 | 15 |
| 102 | 120 | 15 | 12 | 20 |
| 95 | 106 | 18 | 22 | 30 |

Table 2 provides properties of another exemplary embodiment of a copper-based alloy suitable for the present disclosure for use in a sucker rod coupling or subcoupling.

TABLE 2

| | 0.2% Offset Yield Strength (ksi) | Ultimate Tensile Strength (ksi) | Elongation at break (%) | Charpy V-Notch Impact Energy (ft-lbs) |
|---|---|---|---|---|
| Average | 161 | 169 | 6 | N/A |
| Minimum | 150 | 160 | 3 | N/A |

In more particular embodiments, the copper based alloy is commercially available from Materion under the trade name ToughMet® 3 or ToughMet® 2. ToughMet® 2 is nominally a Cu-9Ni-6Sn alloy. ToughMet® 3 is nominally a Cu-15Ni-8Sn alloy. ToughMet® 3 has a 0.2% offset yield strength of about 90 ksi to about 110 ksi; an ultimate tensile strength of about 105 ksi to about 160 ksi; a Rockwell Hardness C of about 22 HRC to about 36 HRC; a coefficient of friction of less than 0.3; and a Charpy V-notch (CVN) toughness of greater than 30 ft-lbs. The 0.2% offset yield strength and ultimate tensile strength are measured according to ASTM E8. The Rockwell C hardness is measured according to ASTM E18. The CVN toughness is measured according to ASTM E23. ToughMet® 3 also resists $CO_2$ corrosion, chloride SCC, pitting, and crevice corrosion. It is also resistant to erosion, HE, SSC and general corrosion (including mildly sour wells) according to NACE MR0172, Guidelines for $H_2S$ environment testing and drilling. Table 3 provides specifications of ToughMet® 3 TS 95 Temper.

TABLE 3

| Mechanical Properties of ToughMet ® 3 TS 95 Temper | |
|---|---|
| 0.2% Offset Yield Strength | 102 ksi |
| Ultimate Tensile Strength | 112 ksi |
| Elongation in 2 in., % | 24% |
| RA % | 57% |
| CVN | 55 (ft-lbs) |
| Hardness | 98 HRB (20.5 HRC) |

The rod couplings of the present disclosure can be made using casting and/or molding techniques known in the art.

Another type of artificial lift coupling is used in the drive shaft of an artificial lift pump powered by a submersible electric motor that is disposed in the well bore or is disposed outside of the well bore. The couplings are used to join segments of the pump drive shaft together and to join the drive shaft to the motor and to the pump impeller. These couplings also include a keyway feature to assure a sound connection between parts. The keyway feature can increase localized stress and is a potential origin source of a crack under torsional load, particularly when starting the motor. Such a failure can be mitigated by using the copper alloys of the present disclosure, which have high strain rate fracture toughness.

The following examples are provided to illustrate the couplings, processes, and properties of the present disclosure. The examples are merely illustrative and are not intended to limit the disclosure to the materials, conditions, or process parameters set forth therein.

EXAMPLES

ToughMet® couplings were installed on over 700 wells. Installation of couplings composing the copper-based alloy material eliminated of approximately half of all well failure events. The wells also saw at least a 6% increase in production and a reduced load on surface equipment.

The examples below make reference to SM couplings. SM couplings are a class of API couplings where the SM stands for "sprayed metal." SM couplings are made up of 5140 alloy steel.

Example 1

Sucker rod couplings made of ToughMet® 3 Cu—Ni—Sn alloys were used on rod strings in selected trial wells with L80 carbon steel production tubing (HRC 22-23 hardness). Mean run time before failure (MTBF) for steel couplings was approximately 10 months. When ToughMet® 3 couplings were installed, the MTBF increased five-fold. No evidence of wear or metal transfer was found in inspected ToughMet® 3 couplings.

One well was shut down 555 days after ToughMet® 3 couplings were installed due to a pump leak. The tubes used to form the well casing were inspected. 50% of tubes that used steel couplings had 30% wall loss, whereas 0% of tubes that used ToughMet® 3 couplings had 30% wall loss. 25% of tubes that used steel couplings had 30% surface pitting, whereas 0% of tubes that used ToughMet® 3 couplings had 30% surface pitting. It was calculated that this would increase MTBF of the tubing by at least three (3) times.

Example 2

55 ToughMet® 3 couplings were installed in the bottom 1,400 feet of a well. The following information was captured:

TABLE 4

| | Prior Practice | ToughMet ® 3 Actual |
|---|---|---|
| Rod/coupling drag coefficient | 0.2 | 0.035 |
| Pump stroke (inches) | 141 | 151 |
| Liquid production (barrels per day) | 233 | 248 |
| Polished rod load (pounds) | 33,000 | 31,570 |

The result of ToughMet® 3 coupling use was a 6.4% increase in liquid production. Results for similar experiments showed production increases of 9%, maximum load decrease of 12%, and increased pump stroke of 21%.

It is thus expected that pump stroke increases of about 3% up to about 40%, or about 6% to about 40%, or about 6% to about 30%, or about 3% to about 10%, or about 6% to about 10% should occur due to the use of these copper-nickel-tin alloys (compared to the use of steel).

It is also expected that liquid production increases of about 3% up to about 40%, or about 6% to about 40%, or about 6% to about 30%, or about 3% to about 10%, or about 6% to about 10% should occur due to the use of these copper-nickel-tin alloys (compared to the use of steel).

Example 3

ToughMet® couplings were installed in ten deviated shale wells that had a history of elevated, frequent failure rates related to tubing/coupling failures. ToughMet® couplings with a 1 inch slim hole were only installed in deviated sections near the bottom of the well or near the surface of the well. These wells were typically 10,000 feet deep and deviated up to 10,000 feet in the horizontal direction. These wells ran about six pump strokes per minute and used L80 production tubing. The wells were evaluated for coupling failures in sections where the ToughMet® couplings were installed. The results of the failure evaluation are shown below in Table 5.

TABLE 5

| Well No. | Days for no failures |
|---|---|
| 1 | 1386 |
| 2 | 1302 |
| 3 | 1232 |
| 4 | 1394 |
| 5 | 1071 |
| 6 | 1064 |
| 7 | 1064 |
| 8 | 1035 |
| 9 | 1025 |
| 10 | 1154 |

After 6 months in the well, some couplings were removed and visually observed. These inspected ToughMet® couplings showed no evidence of wear or metal transfer.

Figure 9:
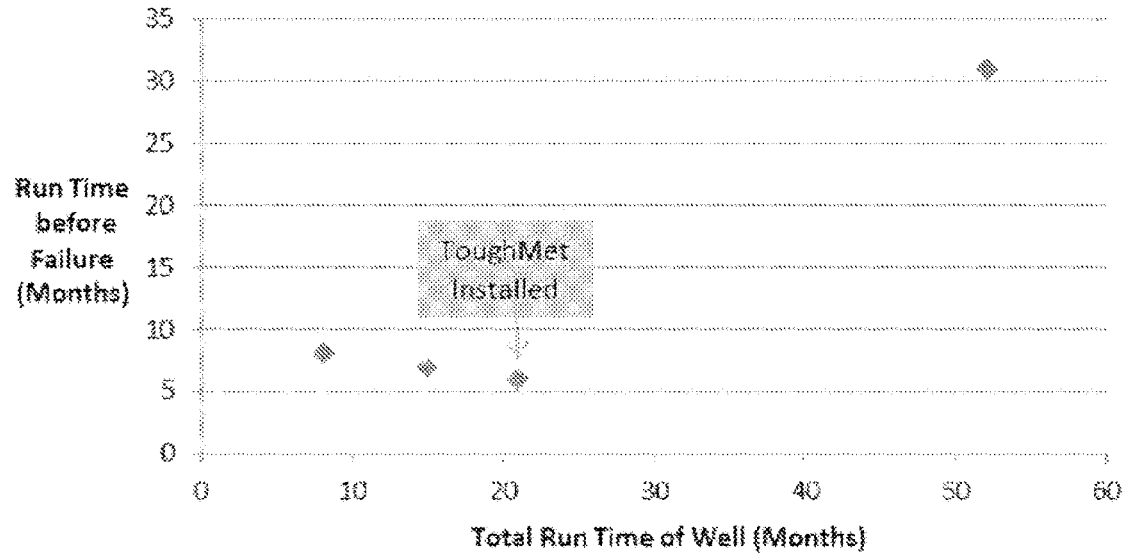
FIG. 9 is a graph illustrating the runtime improvement of an example well using copper-nickel-tin couplings of the present disclosure.

FIG. 9 illustrates the run time improvement of well no. 4. Installation of the ToughMet® couplings occurred at about 20 months of the total run time of the well. This greatly increased the run time of the well before additional failure. The run time for this well increased five-fold as compared to the run time using other couplings. It is thus expected that run time increases of at least 5%, or at least 10%, or at least 100%, or at least 200%, or at least 300% should occur due to the use of these copper-nickel-tin alloys (compared to the use of steel).

After running for 20 months the ToughMet® couplings were removed from well No. 2 and evaluated. The diameter of each removed coupling was measured when it was new (before installation) and after running in the well for 20 months. The individual coupling measurements are shown below in Table 6. The average apparent diametric loss is about 0.020 inches after 20 months of running. The apparent surface loss was found to be 0.010 inches. These couplings were re-installed to the sucker rod sting and since reinstallation have experienced a total runtime of at least 1302 days without issue.

TABLE 6

| New Coupling (in) | Used Coupling (in) | |
|---|---|---|
| 1.998 | 1.968 | 1.959 |
| 1.998 | 1.959 | 1.985 |
| 1.999 | 1.989 | 1.995 |
| 1.997 | 1.990 | 1.956 |
| 1.997 | 1.987 | 1.965 |
| 2.000 | 1.993 | 1.987 |
| Avg. Reading = 1.998 | Avg. Reading = 1.978 | |

Figure 10:
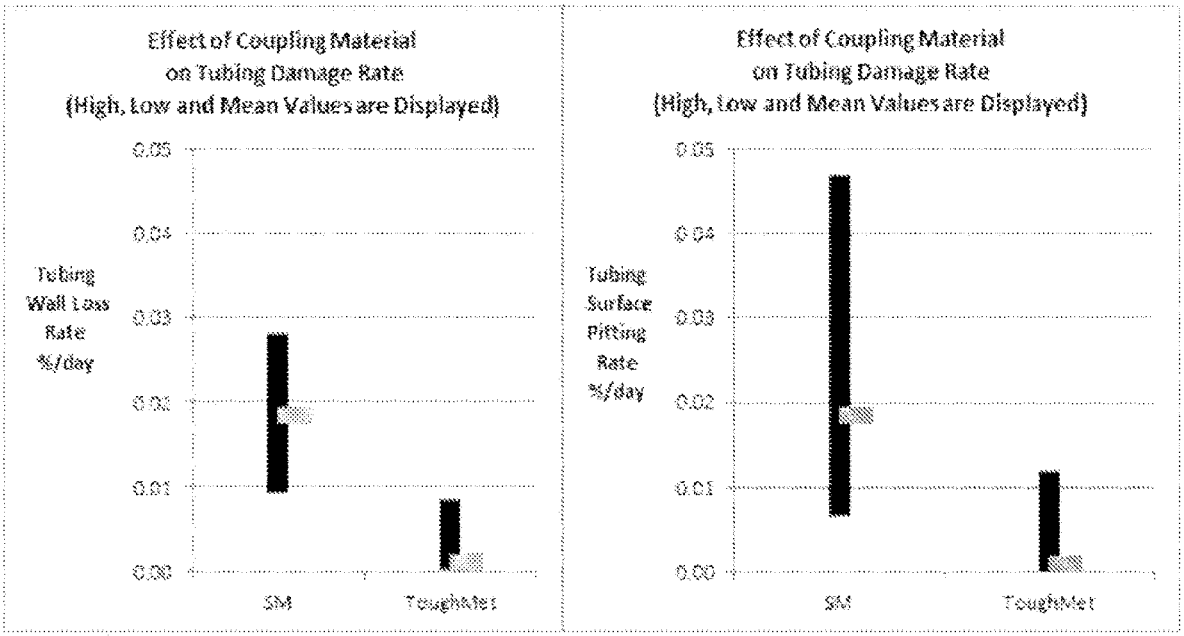
FIG. 10 is a pair of graphs that illustrate the effect of the coupling material on the production tubing damage rate.

Sucker rod sting components in well No. 3 were inspected after 555 days. The tubing was also inspected for wall loss and surface pitting in areas where SM couplings were used versus joint areas where ToughMet® couplings were used. Table 7, below, shows the individual results of pitting % and wall loss % in well tubing for areas near joints with SM couplings and areas near joints with ToughMet® couplings. Joints 251-289 used SM couplings. Joints 290-311 used ToughMet® couplings. The results are summarized in Table 8. FIG. 10 illustrates the effect of the coupling material on the tubing damage rate. Shown in this figure are the high, the low, and mean values of the tubing wall loss rate and tubing surface pitting rate as a %/day.

TABLE 7

| Joint No. | Pitting % | Wall Loss % |
|---|---|---|
| 251 | 12 | 24 |
| 252 | 12 | 13 |
| 253 | 13 | 16 |
| 254 | 9 | 13 |
| 255 | 12 | 16 |
| 256 | 15 | 21 |
| 257 | 12 | 18 |
| 258 | 18 | 12 |
| 259 | 12 | 22 |
| 260 | 15 | 17 |
| 261 | 12 | 18 |
| 262 | 9 | 12 |
| 263 | 15 | 13 |
| 264 | 15 | 17 |
| 265 | 21 | 18 |
| 266 | 18 | 23 |
| 267 | 18 | 17 |
| 268 | 18 | 21 |
| 269 | 27 | 16 |
| 270 | 15 | 32 |
| 271 | 27 | 20 |
| 272 | 21 | 25 |
| 273 | 16 | 36 |
| 274 | 21 | 14 |
| 275 | 15 | 18 |
| 276 | 21 | 20 |
| 277 | 36 | 30 |
| 278 | 15 | 32 |
| 279 | 10 | 30 |
| 280 | 12 | 25 |
| 281 | 36 | 38 |
| 282 | 18 | 33 |
| 283 | 18 | 14 |
| 284 | 39 | 15 |
| 285 | 38 | 43 |
| 286 | 21 | 14 |
| 287 | 20 | 21 |
| 288 | 18 | 20 |
| 289 | 10 | 17 |
| 290 | 15 | 25 |
| 291 | 15 | 23 |
| 292 | 16 | 14 |
| 293 | 15 | 12 |
| 294 | 15 | 17 |
| 295 | 23 | 24 |
| 296 | 15 | 17 |
| 297 | 15 | 18 |

TABLE 7-continued

| Joint No. | Pitting % | Wall Loss % |
|---|---|---|
| 298 | 9 | 17 |
| 299 | 9 | 17 |
| 300 | 15 | 19 |

TABLE 8

| Coupling Material | SM | ToughMet |
|---|---|---|
| % of tubes having ≥30% wall loss | 50 | 0 |
| % of tubes having ≥30% surface pitting | 25 | 0 |

Example 4

Figure 11:
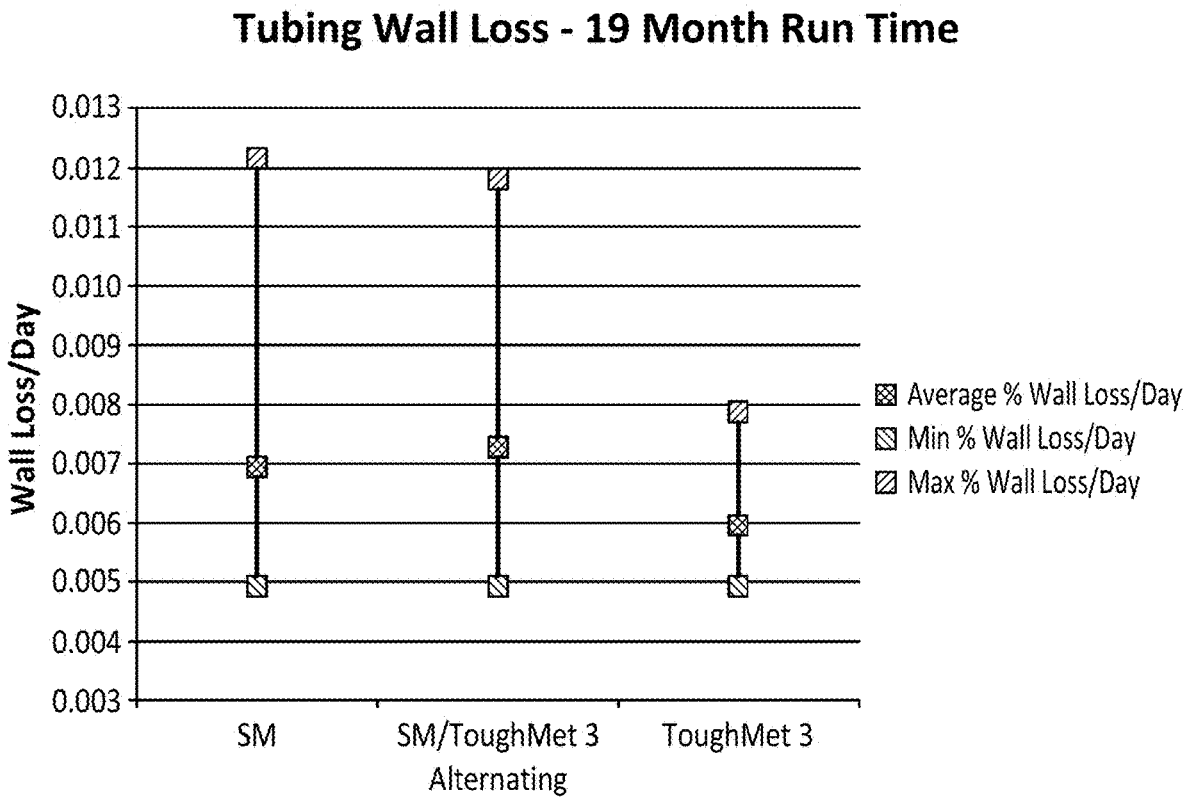
FIG. 11 is a graph illustrating tubing wall loss in a 19-month run time.

New L80 production tubing was installed in a well. The well was run with SM couplings for 19 months. After 19 months, ToughMet® couplings were installed in joints 292-315 corresponding to depths of 8,746 feet through 9,446 feet. ToughMet® couplings were installed and alternated with SM couplings in joints 192 through 292 corresponding to depths of 5,746 feet to 8,746 feet. SM couplings were installed in joints 1 through 192 corresponding to the surface level to a depth of 5,746 ft. FIG. 11 is a graph illustrating the tubing wall loss as a percentage of wall loss per day. The graph shows the min, max, and average values. As shown in the graph, the joint areas where the ToughMet® couplings were installed exhibited the lowest percentage of wall loss (both lowest average, and lowest max value).

Example 5

ToughMet® couplings were installed in sections of a sucker rod string. In over 44 months of continuous run time, there were no HIT failures in the ToughMet® sections. All of the ToughMet® couplings in the sections were subsequently removed and inspected, and were all found suitable for placement back into service. The well with the reintroduced couplings continued to produce.

Example 6

Figure 12:
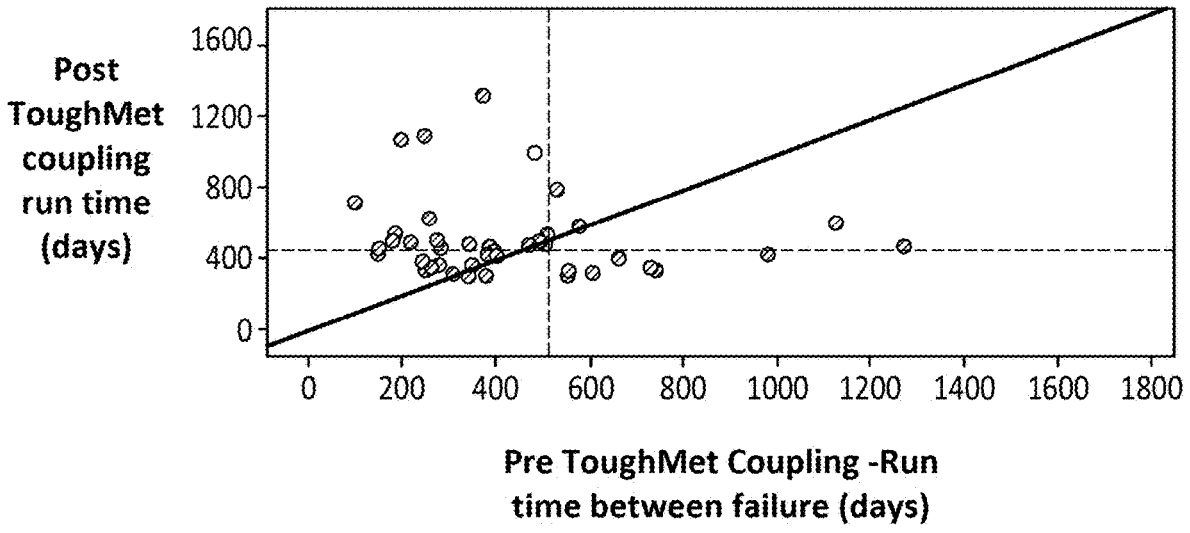
FIG. 12 is a graph showing the data analytics of pre-copper-based coupling installation run time in days and post copper-based coupling installation run time.

Increased run time was shown in 41 wells using L80 production tubing with 30 to 40 ToughMet® couplings installed per well. FIG. 12 is a graph showing the data analytics of pre-installation of ToughMet® couplings run time (x-axis) and post-installation of ToughMet® couplings run time (y-axis). Above the diagonal line is preferable.

Example 7

Figure 13:
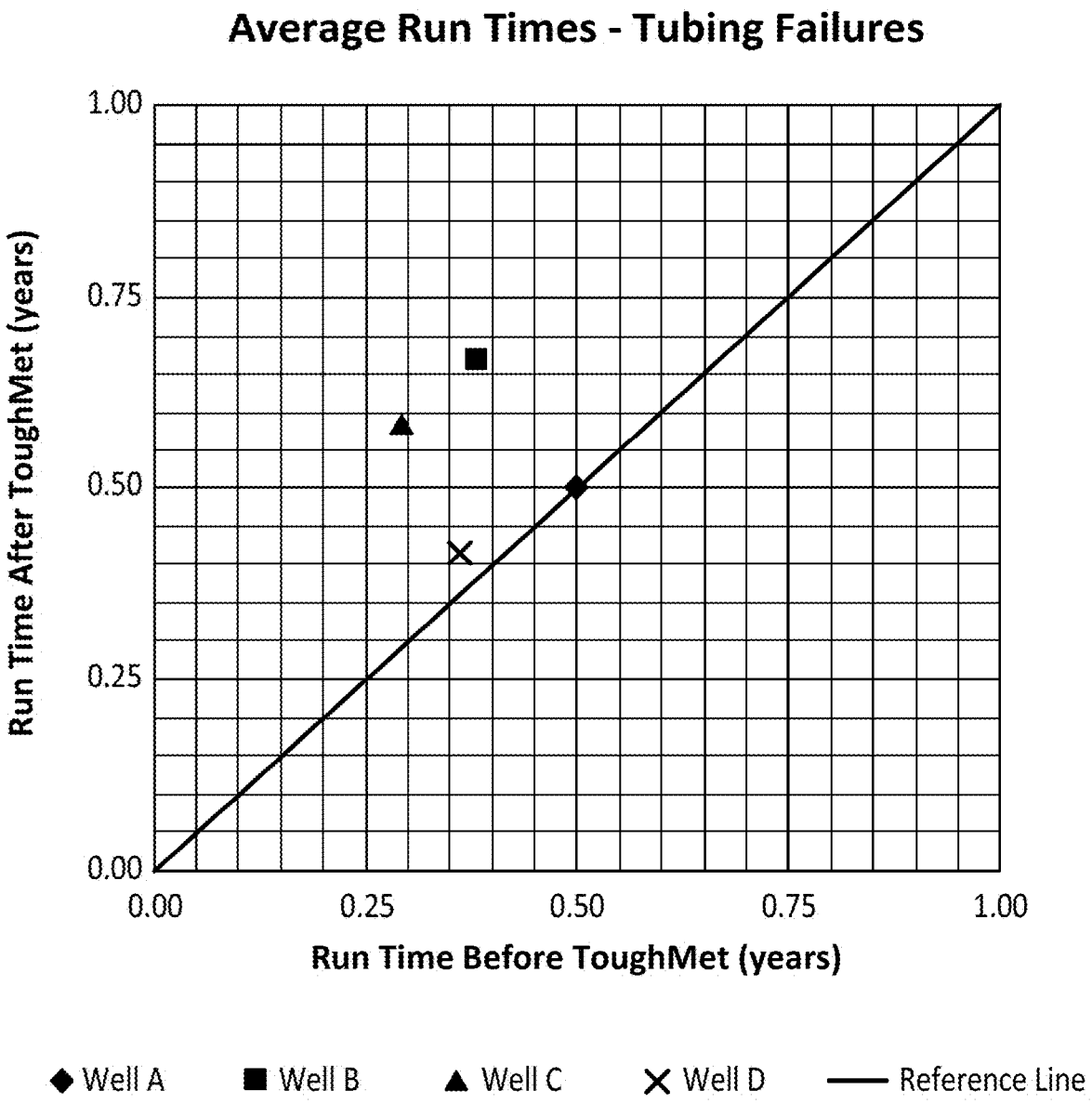
FIG. 13 is a graph showing the Average Run Times-Tubing Failures before and after installation of copper-nickel-tin couplings in accordance with the present disclosure.

Run time gains were measured after about one year of running ToughMet® couplings in the bottom 1,000-1,400 feet of rod string for four wells. Here, 40-36 ToughMet® couplings were installed per well using L80 and 5JTS of Enduralloy™ at the bottom production tubing. FIG. 13 is a graph showing the Average Run Times-Tubing Failures before and after installing ToughMet® couplings. The results are summarized in Table 9 below and show the tubing failures prevented each year for each well.

TABLE 9

| Well | Tubing Failures/ Yr. Prevented |
|---|---|
| Well A | 0.000 |
| Well B | 1.109 |
| Well C | 1.714 |
| Well D | 0.369 |
| AVERAGE | 0.798 |

Example 8

ToughMet® couplings were applied to longer sections of the sucker rod string (instead of just near deviated portions of the well). In summary, results showed that production increased while drag was reduced. Also observed were significant pump stroke increases, smoother movements of the rod string, and significant decreases in system mechanical loads.

Here, 55 ToughMet® couplings were installed in the bottom 1,400 feet of a rod string. The couplings included 24 "¾ inch Full" couplings and 31 "1 inch Slim" couplings. The results are listed in Table 10 below.

TABLE 10

| Rod/Coupling | Prior Standard | ToughMet ® Hypothesis | ToughMet ® Hypothesis | ToughMet ® Actual |
|---|---|---|---|---|
| Drag Coefficient | 0.2 | 0.1 | 0.05 | 0.35 |
| Liquid Production | 233 bpd | 240 bpd (3%) | 243 bpd (4%) | 248 bpd (6.5%) |
| Polished rod load-pounds | 33,000 | 32,500 | 32,500 | 31,570 |
| Gear box max design load exceedance % | 5 | 3 | 1 | Minus 2 |
| Pump stroke-in | 141 | 146 | 148 | 151 |

Figure 14A:
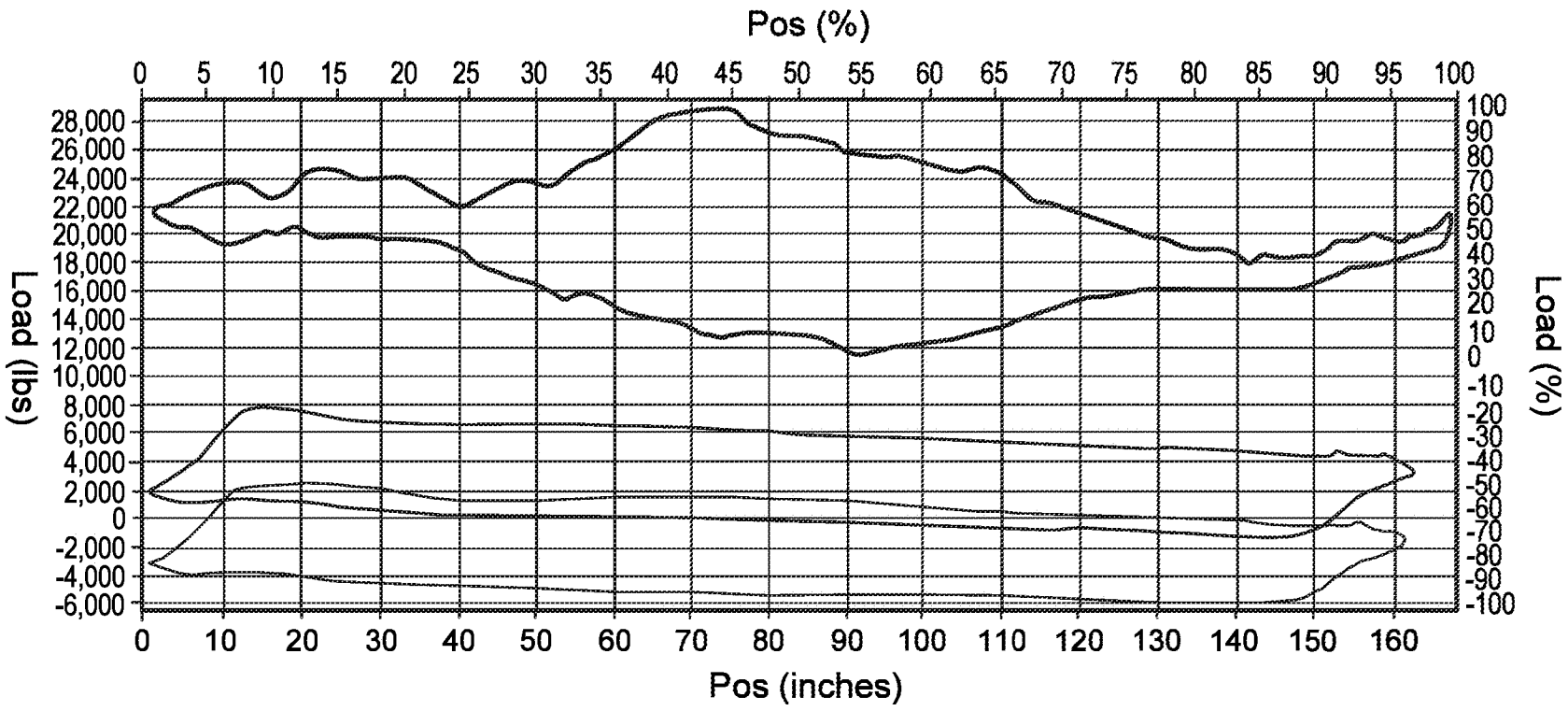
FIG. 14A is a well pump card before installation of copper-nickel-tin alloy couplings in accordance with the present disclosure.
Figure 14B:
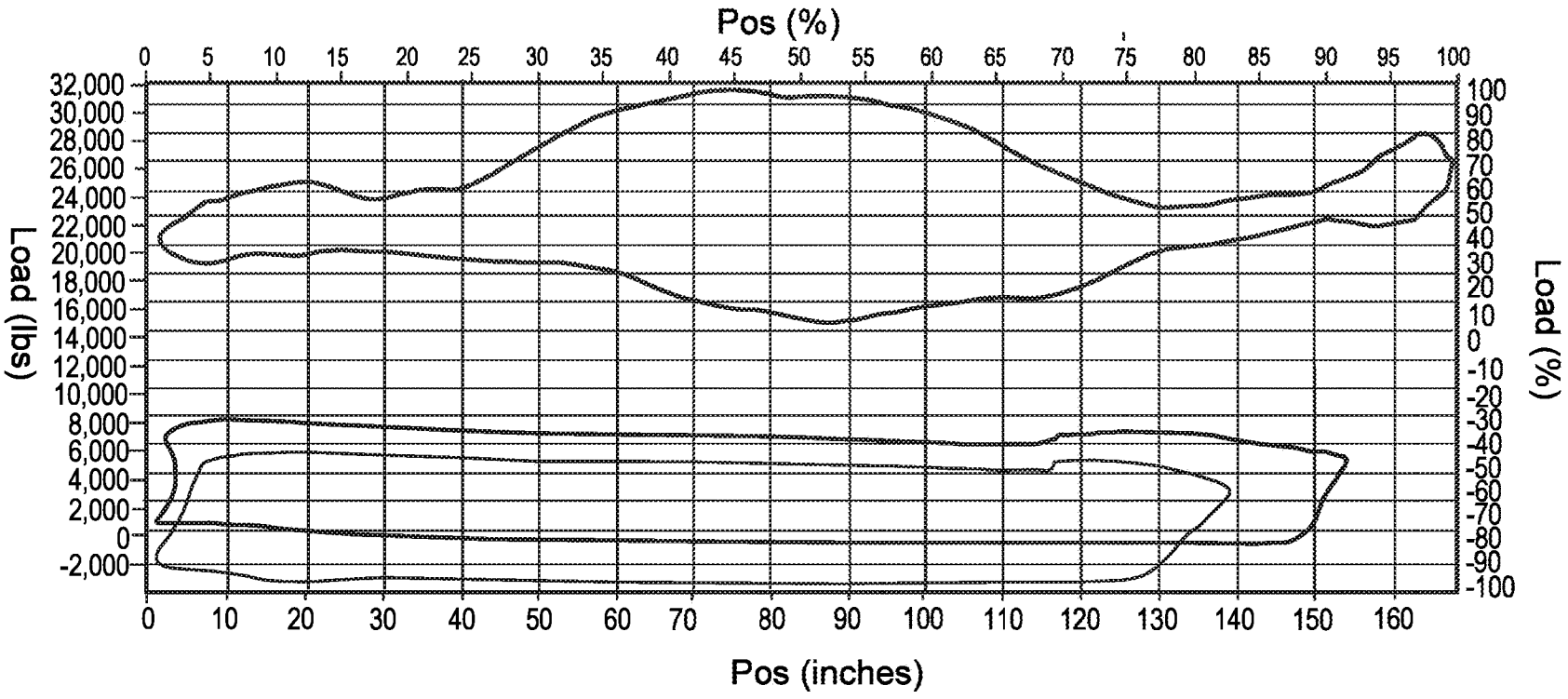
FIG. 14B is a well pump card after installation of copper-nickel-tin alloy couplings in accordance with the present disclosure.

FIG. 14A and FIG. 14B illustrate pump cards of the well before and after installation of the copper-alloy couplings in the % inch and 1 inch bottom section of the well and tubing. FIG. 14A shows erratic movement of the top load curve, possibly indicating sticking of the rods. FIG. 14B, wherein the sucker rod string includes copper-based couplings, shows a smoother curve, indicating a lower friction force. Thus, the copper-based material of the couplings reduce the friction between the rod string components and production tubing.

Figure 15:
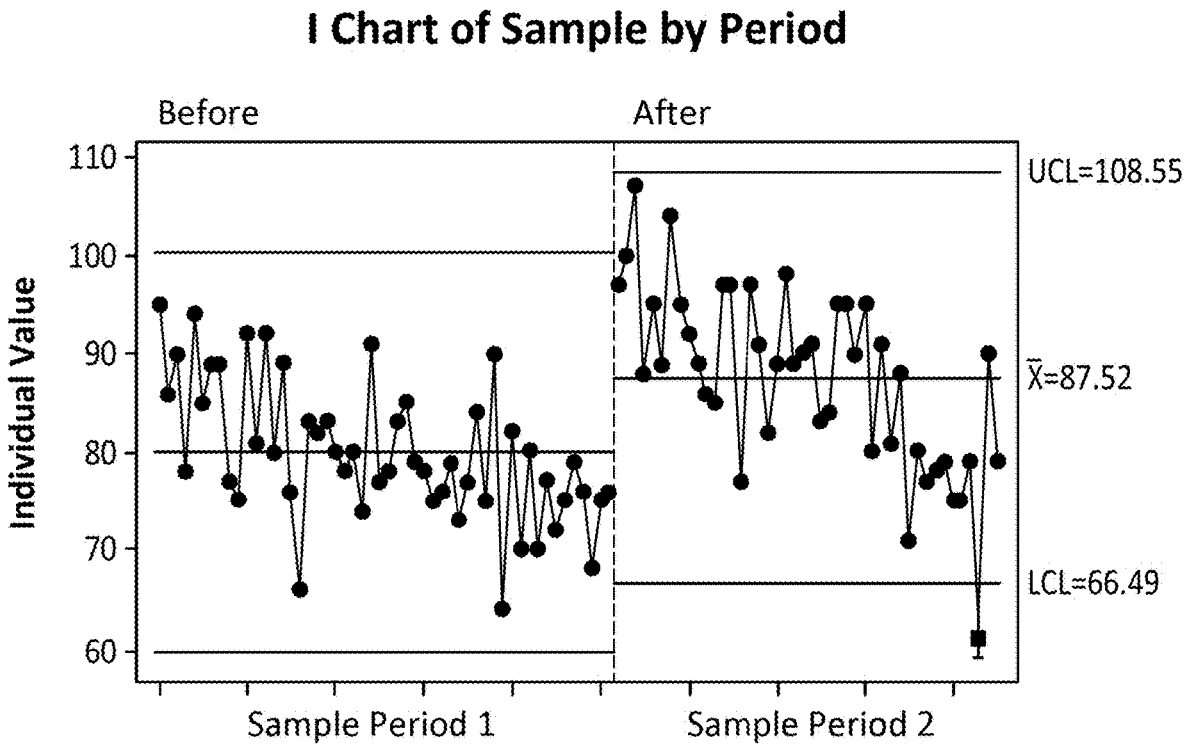
FIG. 15 is a chart illustrating the production of a well over sample periods before and after installation of copper-based couplings in accordance with the present disclosure.

This well also showed a production increase of 9% after installing 55 ToughMet® couplings. FIG. 15 is a chart illustrating the production over a sample period before and after installation of the copper-based couplings. The left area shows the production during a Sample Period 1 before the installation of the copper-based alloy couplings, and the right area shows the production during a Sample Period 2 after the installation of copper-based alloy couplings. As can be seen, production is higher during Sample Period 2.

Example 9

Figure 16:
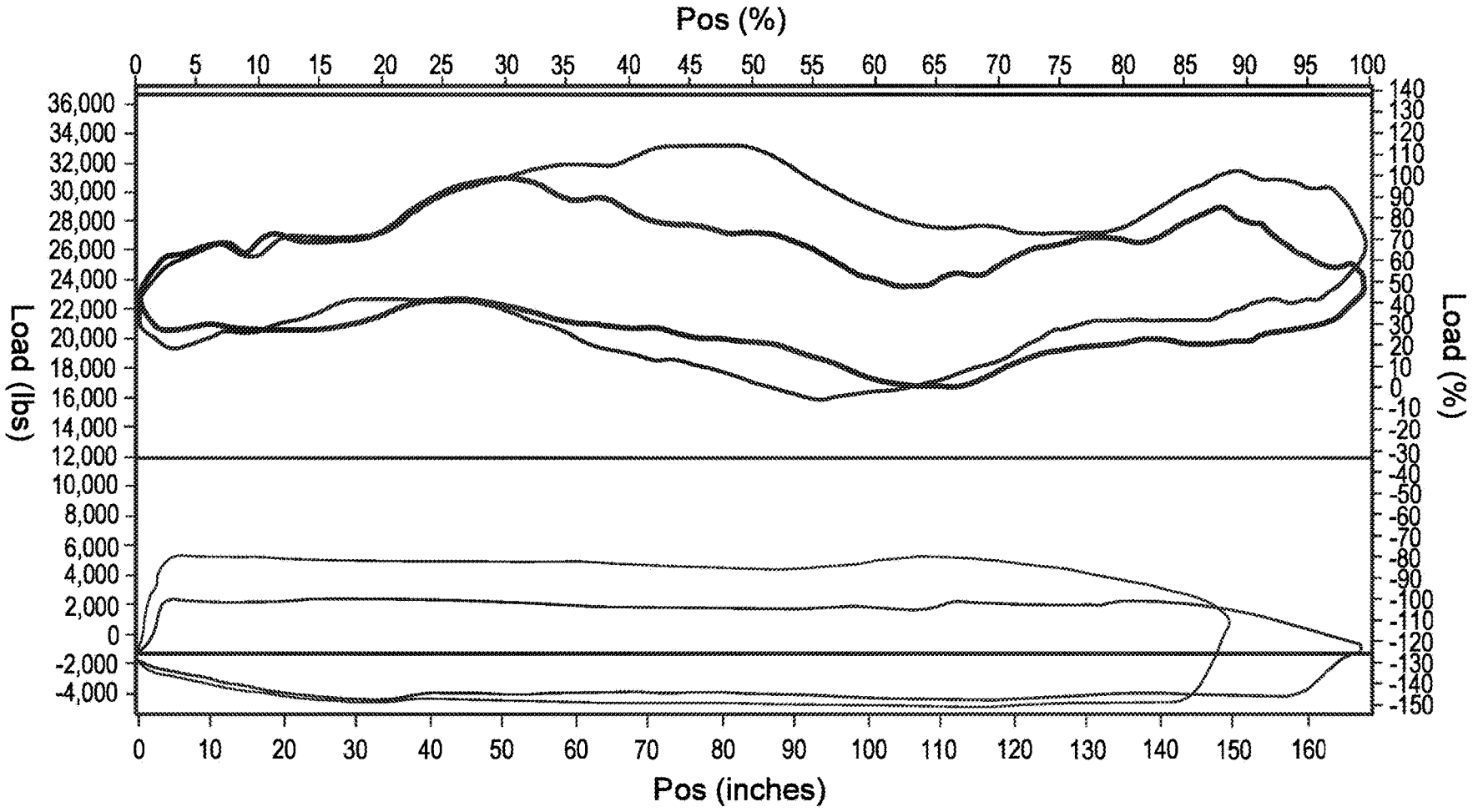
FIG. 16 is a pump card that compares well pumping pre and post installation of copper-based alloy couplings.

An operator installed ToughMet® couplings in the bottom 40 joints of a sucker rod string. FIG. 16 is a comparative pump card where operational data from pre and post ToughMet® coupling installations are overlapped. The data indicates that the Max load was decreased by 12% and the pump stroke increased by 21% when the ToughMet® couplings were installed.

Example 10

Two similar wells were prepared with each sucker rod string using a different type of coupling. The sucker rod string of Well 1 was assembled with each coupling made of a copper-based alloy material. Specifically, the couplings of Well 1 were made of ToughMet® 3 material. The sucker rod string of Well 2 was assembled with each coupling being an SM class coupling (steel alloy).

Figure 17:
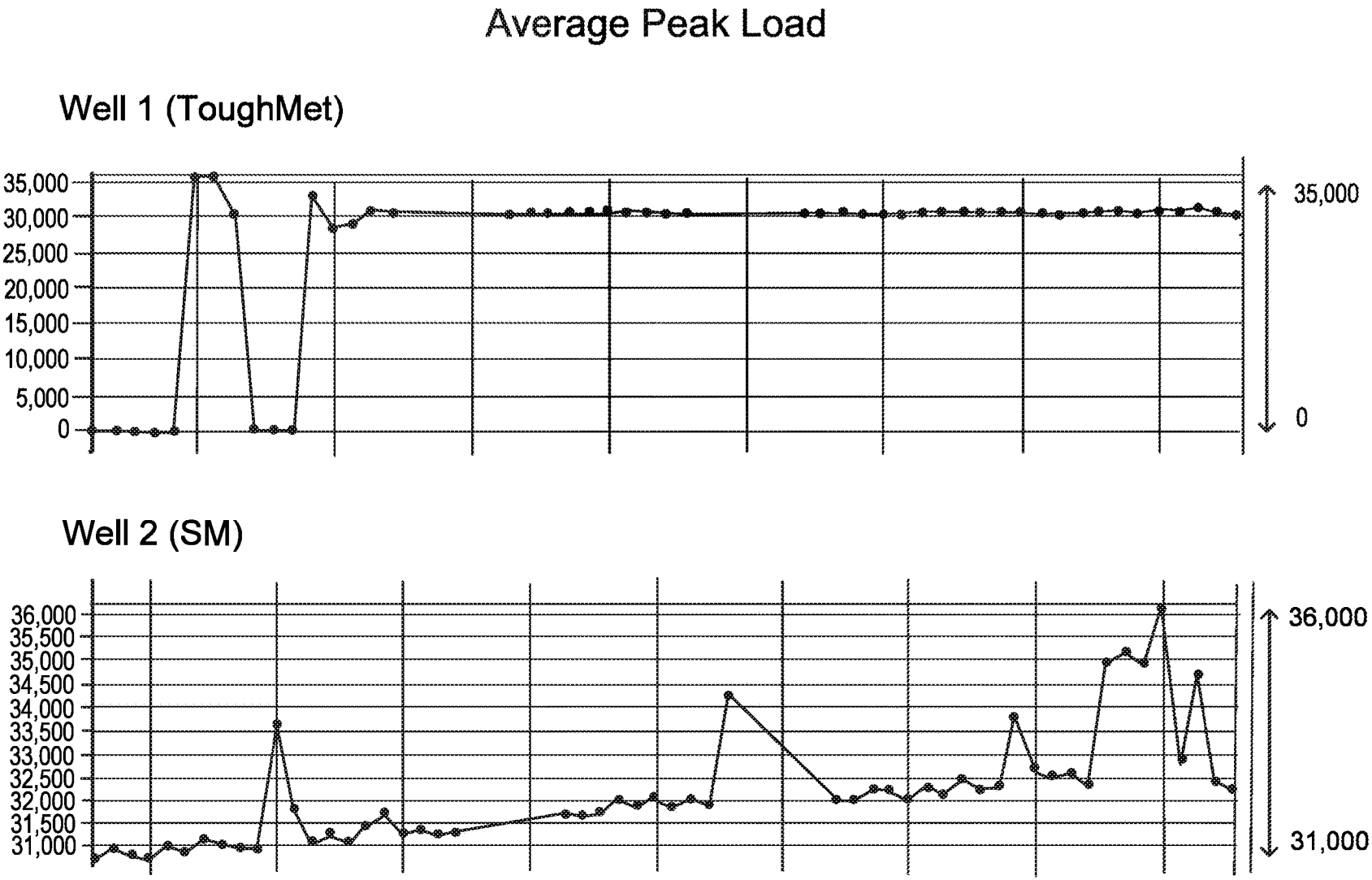
FIG. 17 shows two graphs that illustrate measurements of average peak load in a well with couplings in accordance with the present disclosure and a well with SM couplings.

As illustrated in FIG. 17, the average peak load was observed to be lower and more consistent in Well 1 when compared to Well 2. It is expected that the average peak load may be reduced by at least 5% due to the use of these copper-nickel-tin alloys (compared to the use of steel).

Figure 18:
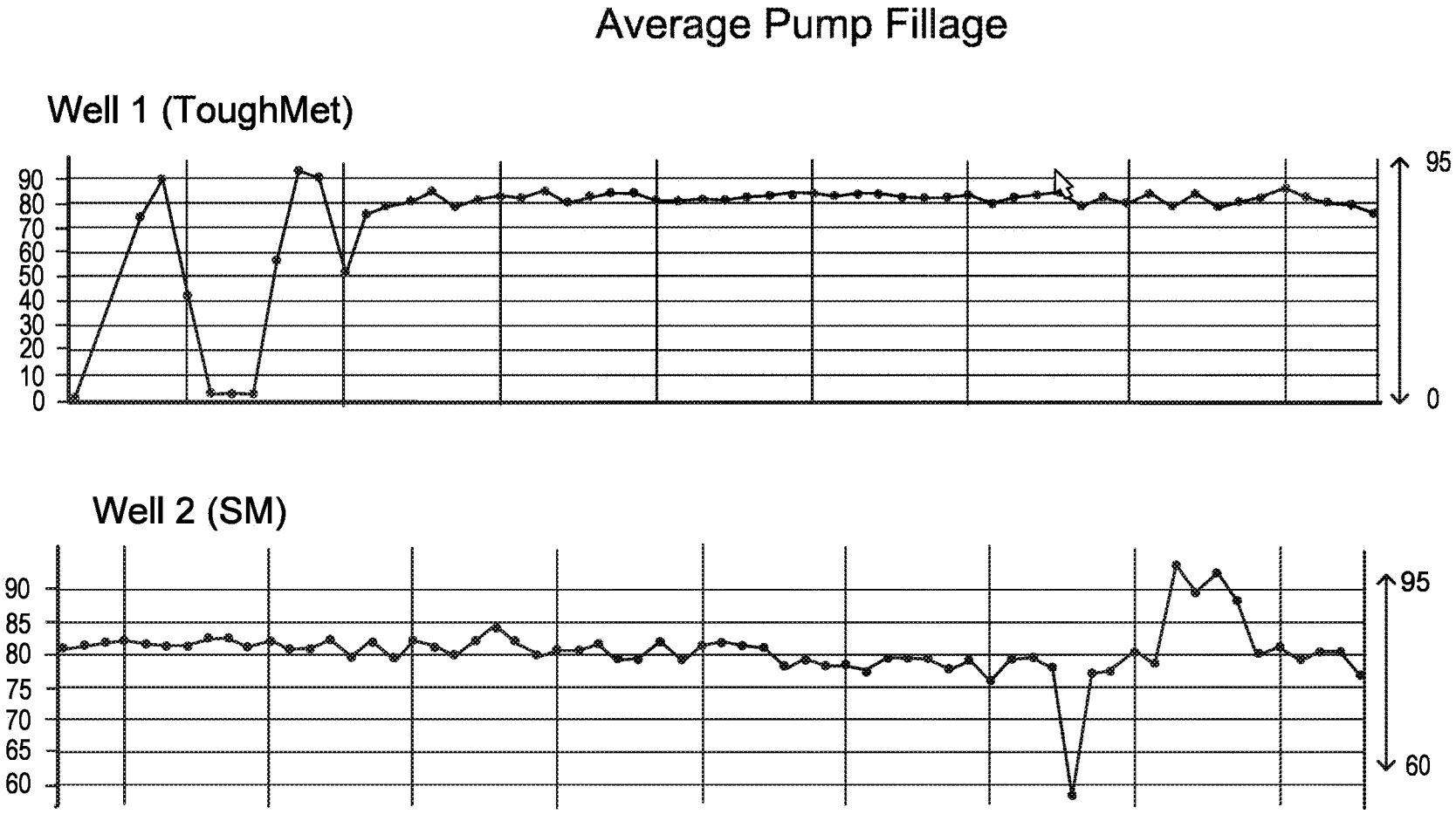
FIG. 18 shows two graphs that illustrate measurements of average pump fillage in a well with couplings in accordance with the present disclosure and a well with SM couplings.

The average pump fillage was also observed to be greater in Well 1 when compared to Well 2. The pump fillage measurements of each well are compared and illustrated in FIG. 18.

Figure 19:
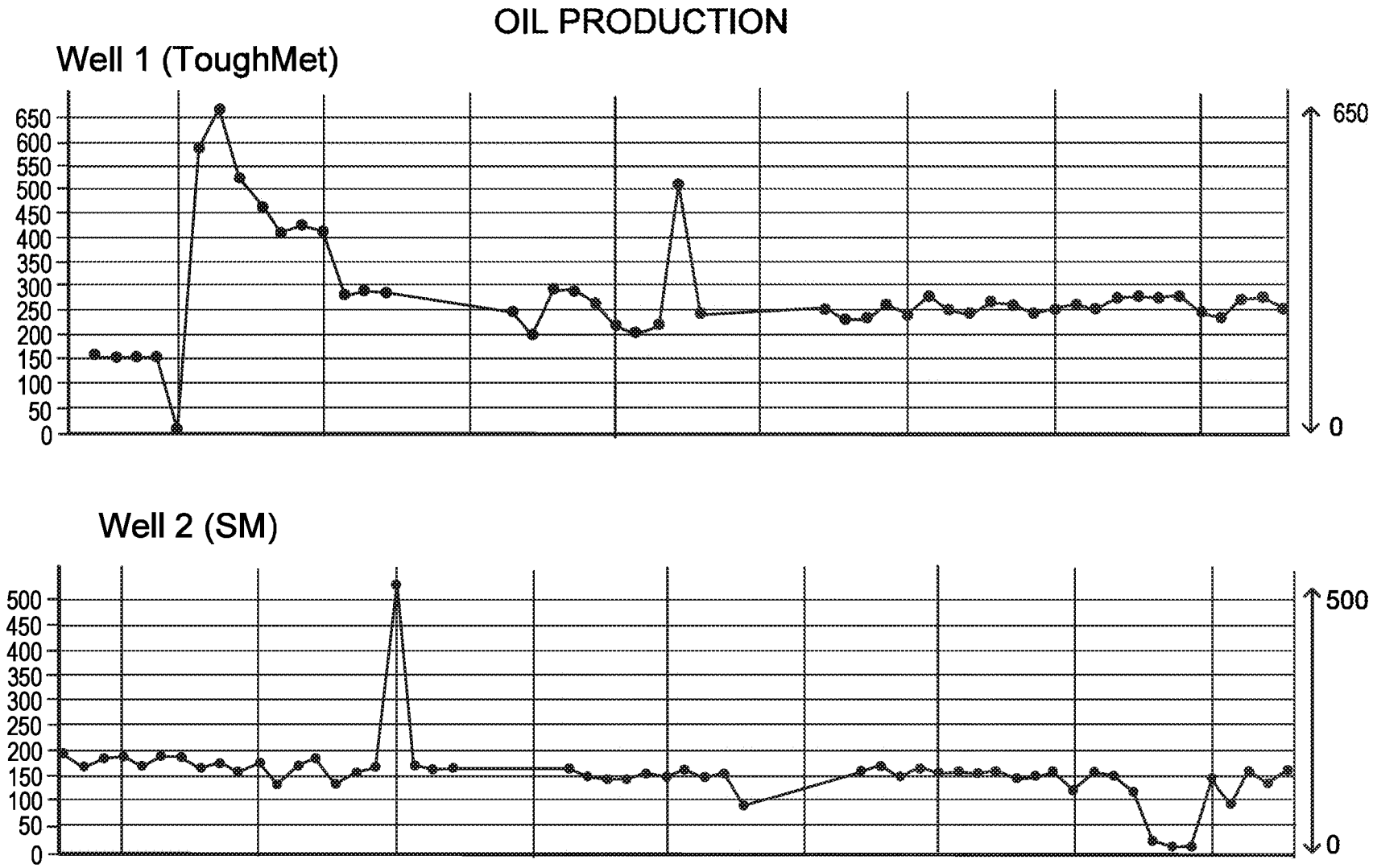
FIG. 19 shows two graphs that illustrate measurements of oil production in a well with couplings in accordance with the present disclosure and a well with SM couplings.

Well 1 also produced more oil than Well 2. The production measurements of each well are compared and illustrated in FIG. 19.

Example 11

Figure 28:
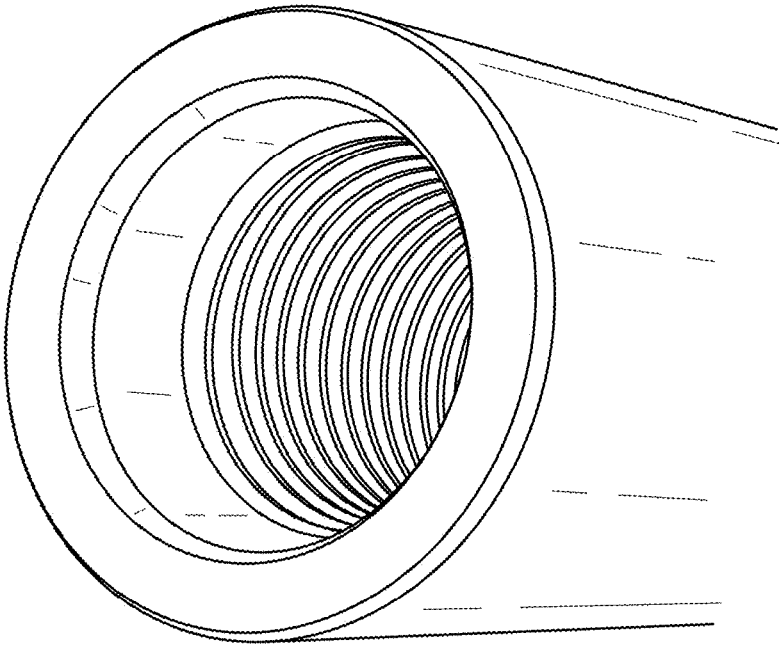
FIG. 28 is a picture of one end of a sucker rod coupling made from a copper alloy according to the present disclosure.

Two sucker rod couplings were made from a spinodally hardened copper alloy. The copper alloy was 15.1 wt % nickel, 8.2 wt % tin, 0.23 wt % manganese, and contained less than 0.05 wt % Nb, less than 0.02 wt % of Zn and Fe, and less than 0.01 wt % of Mg and Pb. The copper alloy had a 0.2% offset yield strength of 102 ksi, and an ultimate tensile strength of 112 ksi. The coupling had a nominal size of 1 inch according to API Specification 11B. The threads were roll formed using a tap for the operation. FIG. 28 is a picture of one end of the coupling.

Figure 29:
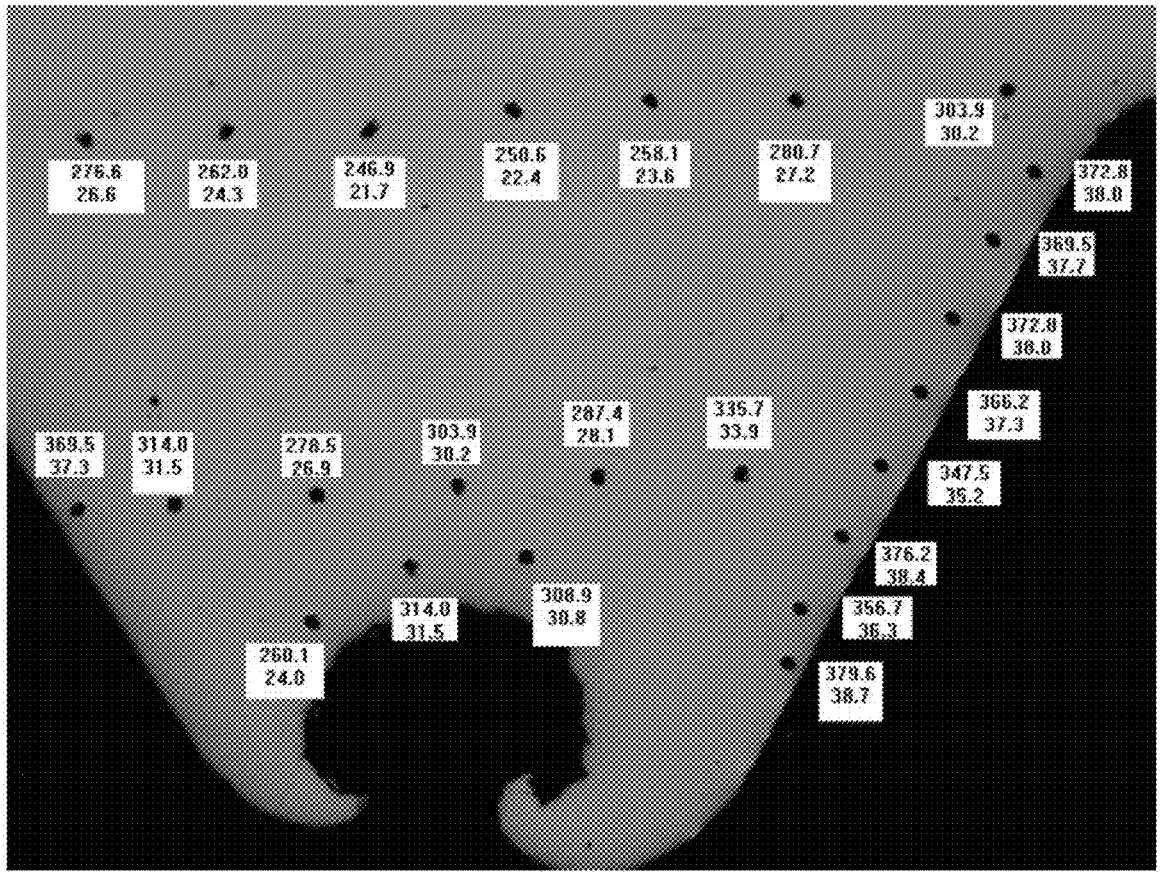
FIG. 29 is a picture showing the measured hardness across an internal thread of a coupling made from a copper alloy according to the present disclosure (50×).

Destructive testing was performed. A sample was sawed in half and the threads were mounted and polished for analysis. A hardness test was performed at various locations on the part. FIG. 29 is a picture indicating the measured values. The measured Vickers hardness (HV) is reported on top, and the Rockwell C hardness (HRC) is reported on the bottom (converted from the HV). As seen here, the HRC varied from a low of 21.7 at the interior of the thread to a high of 38.7 at the outer surface of the thread. All of the HRC values on the outer surface of the thread were above 35. The average grain size was 23 microns. The grains were elongated on the outer surface of the threads.

Figure 30:
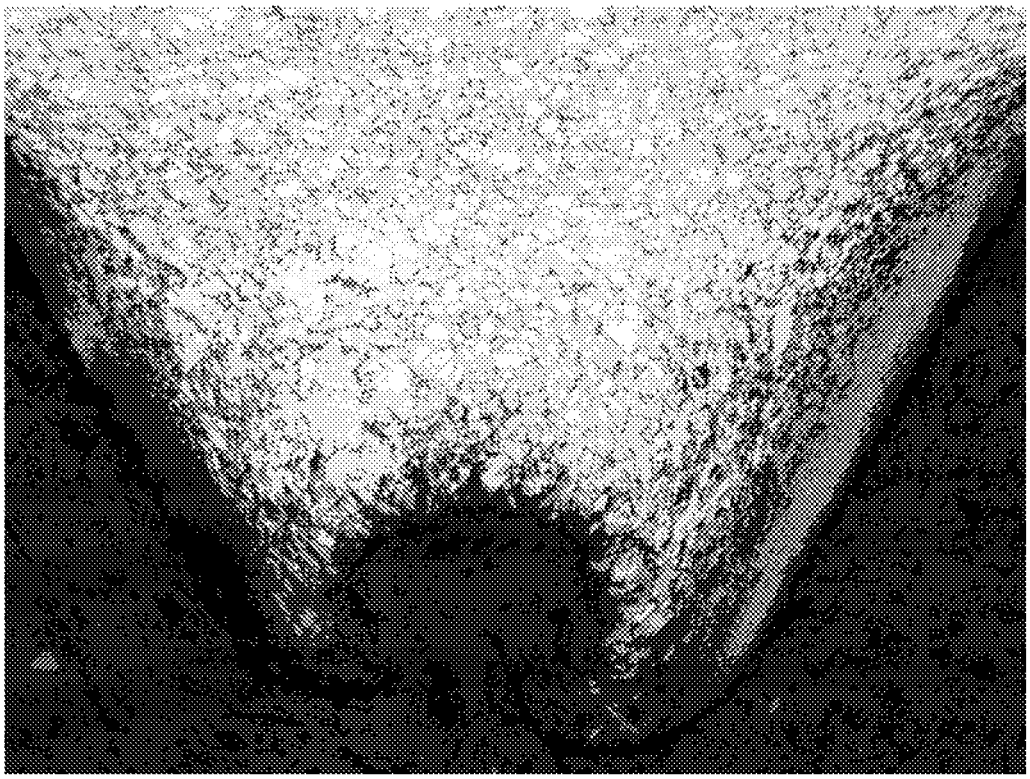
FIG. 30 is a micrograph at 50× magnification showing the grain structure of the entire thread.
Figure 31:
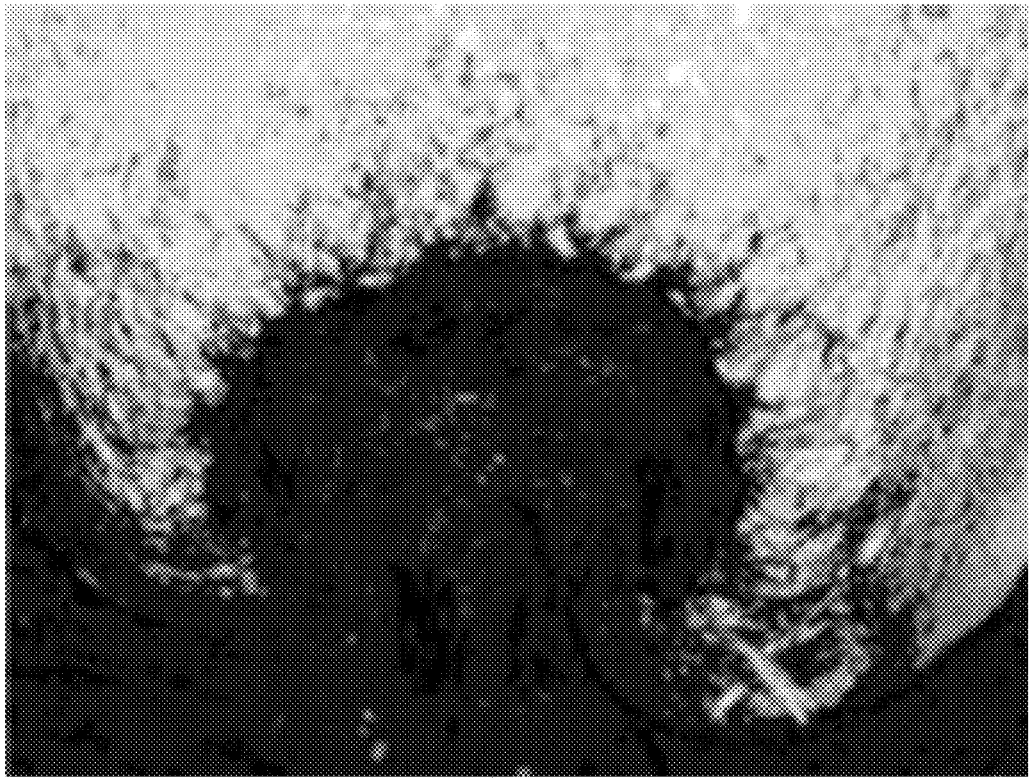
FIG. 31 is a micrograph at 100× magnification showing the grain structure of the tip of the thread.
Figure 32:
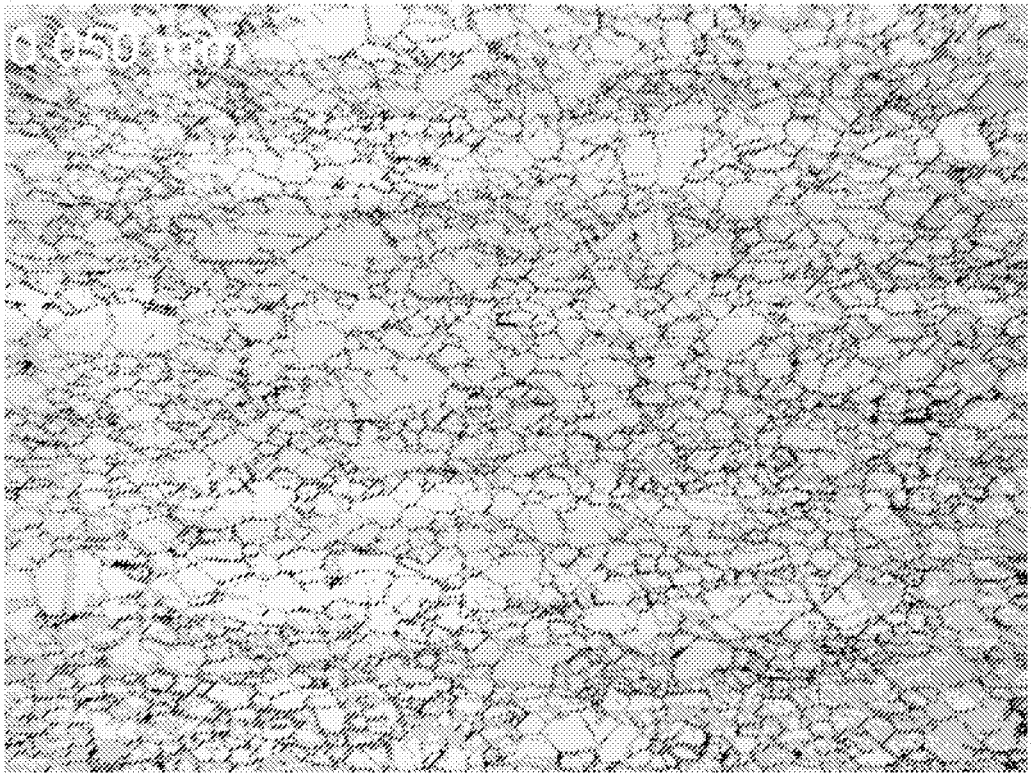
FIG. 32 is a micrograph at 100× magnification showing the grain structure at the center of the thread.
Figure 33:
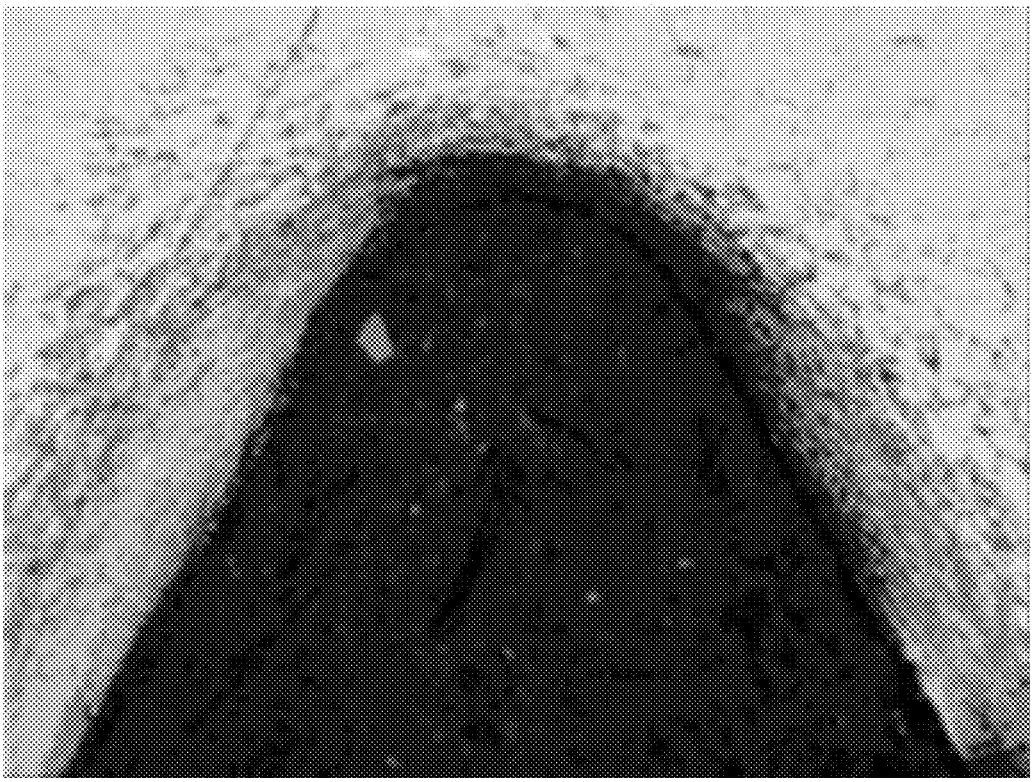
FIG. 33 is a micrograph at 100× magnification showing the grain structure at the thread root.
Figure 34:
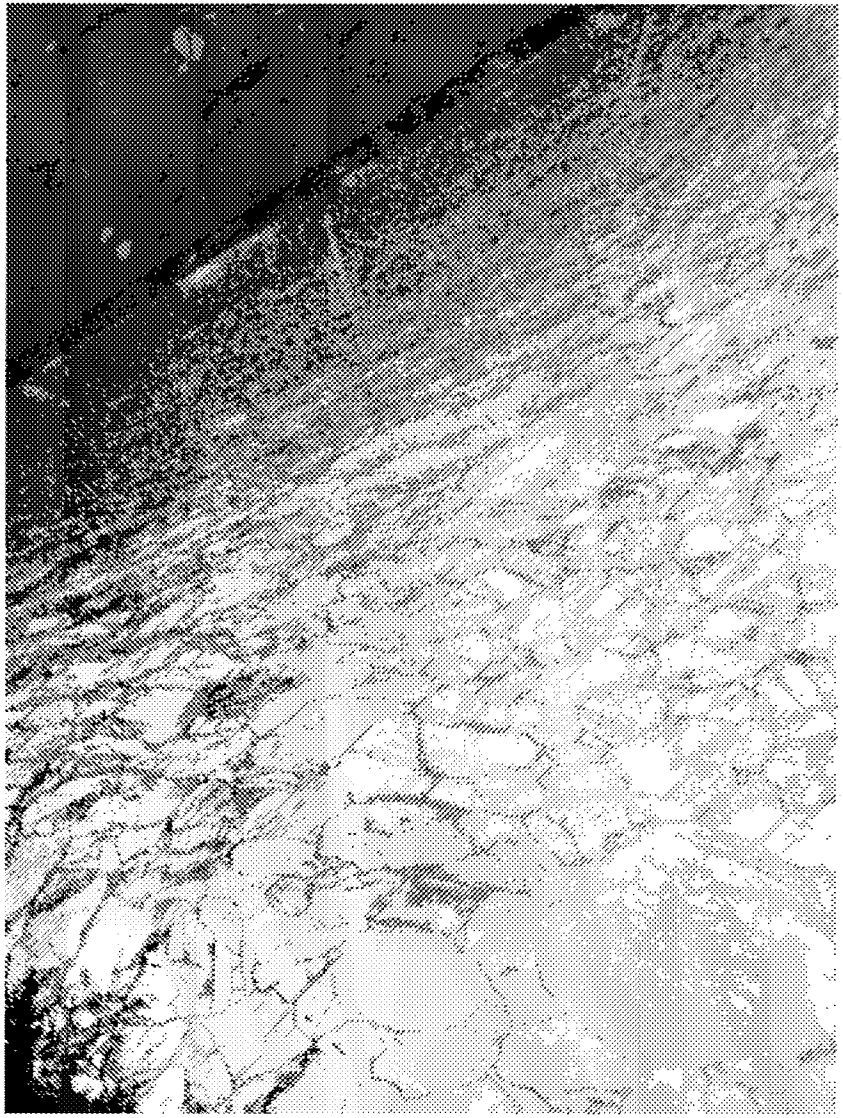
FIG. 34 is a micrograph at 200× magnification showing the grain structure at the side of the thread.

FIGS. 30-34 are various micrographs of the sample. FIG. 30 is a micrograph at 50× magnification showing the grain structure of the entire thread. FIG. 31 is a micrograph at 100× magnification showing the grain structure of the tip of the thread. FIG. 32 is a micrograph at 100× magnification showing the grain structure at the center of the thread. FIG. 33 is a micrograph at 100× magnification showing the grain structure at the thread root. FIG. 34 is a micrograph at 200× magnification showing the grain structure at the side of the thread.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A coupling for a sucker rod comprising:

a copper-nickel-tin alloy comprising from about 8 wt % to about 20 wt % nickel, and from about 5 wt % to about 11 wt % tin, the copper-nickel-tin alloy having:

a Yield Strength 0.2% offset of at least 75 ksi, and an Ultimate Tensile Strength of at least 105 ksi.

2. The coupling according to claim 1, the copper-nickel-tin alloy having an Elongation at break of at least 15%.

3. The coupling according to claim 1, the copper-nickel-tin alloy having an Elongation at break of at least 18%.

4. The coupling according to claim 1, the copper-nickel-tin alloy having a Hardness (HRC) of about 15 to about 40.

5. The coupling according to claim 1, the copper-nickel-tin alloy having a Hardness (HRB) of about 93 to about 111.

6. The coupling according to claim 1, the copper-nickel-tin alloy having Yield Strength 0.2% offset of about 90 ksi to about 110 ksi.

7. The coupling according to claim 1, the copper-nickel-tin alloy having an Ultimate Tensile Strength of about 105 ksi to about 160 ksi.

8. The coupling according to claim 1, the copper-nickel-tin alloy comprising from about 14.5 wt % to about 15.5 wt % nickel, and from about 7.5 wt % to about 8.5 wt % tin.

9. The coupling according to claim 8, the copper-nickel-tin alloy having a Hardness (HRB) of at least 93.

10. The coupling according to claim 8, the copper-nickel-tin alloy having an Elongation at break of at least 15%.

11. The coupling according to claim 8, the copper-nickel-tin alloy having:

a Yield Strength 0.2% offset of at least 90 ksi, an Ultimate Tensile Strength of at least 105 ksi, and an Elongation at break of at least 15%.

12. The coupling according to claim 8, the copper-nickel-tin alloy having:

a Yield Strength 0.2% offset of at least 102 ksi, an Ultimate Tensile Strength of at least 112 ksi, and an Elongation at break of at least 18%.

13. The coupling according to claim 8, the copper-nickel-tin alloy having a Hardness (HRC) of about 22 to about 36.

14. A sucker rod string comprising:

a set of couplings, wherein the set of couplings includes a plurality of couplings made from a copper-nickel-tin alloy comprising from about 8 wt % to about 20 wt % nickel, and from about 5 wt % to about 11 wt % tin, and the copper-nickel-tin alloy having:

a Yield Strength 0.2% offset of at least 75 ksi, and an Ultimate Tensile Strength of at least 105 ksi.

15. The sucker rod string according to claim 14, the copper-nickel-tin alloy comprising from about 14.5 wt % to about 15.5 wt % nickel, and from about 7.5 wt % to about 8.5 wt % tin.

16. A pump system comprising:

a downhole pump;

a power source for powering the downhole pump; and a sucker rod string operatively connected to the downhole pump and the power source; wherein the sucker rod string comprises a set of couplings, wherein the set of couplings includes a plurality of couplings made from a copper-nickel-tin alloy comprising from about 8 to about 20 wt % nickel, and from about 5 to about 11 wt % tin, and the copper-nickel-tin alloy having:

a Yield Strength 0.2% offset of at least 75 ksi, and an Ultimate Tensile Strength of at least 105 ksi.

17. The pump system according to claim 16, the copper-nickel-tin alloy comprising from about 14.5 wt % to about 15.5 wt % nickel, and from about 7.5 wt % to about 8.5 wt % tin.

18. A method of extracting fluid from a well, the method comprising:

operatively connecting a downhole pump to a motor using a sucker rod string; wherein the sucker rod string comprises a set of couplings, wherein the set of couplings includes a plurality of couplings made from a copper-nickel-tin alloy comprising from about 8 wt % to about 20 wt % nickel, and from about 5 wt % to about 11 wt % tin, and the copper-nickel-tin alloy having:

a Yield Strength 0.2% offset of at least 75 ksi, and an Ultimate Tensile Strength of at least 105 ksi.

19. The method according to claim 18, the copper-nickel-tin alloy comprising from about 14.5 wt % to about 15.5 wt % nickel, and from about 7.5 wt % to about 8.5 wt % tin.

20. The method according to claim 19, the copper-nickel-tin alloy having:

a Yield Strength 0.2% offset of at least 90 ksi, an Ultimate Tensile Strength of at least 105 ksi, and an Elongation at break of at least 15%.

* * * * *